US011724485B2

(12) United States Patent
Chassot

(10) Patent No.: US 11,724,485 B2
(45) **Date of Patent: *Aug. 15, 2023**

(54) GRAVURE PRINTING UNIT WITH INKING UNIT CYLINDERS

(71) Applicant: KOENIG & BAUER AG, Würzburg (DE)

(72) Inventor: Daniel Chassot, Bienne (CH)

(73) Assignee: KOENIG & BAUER AG, Würzburg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/771,542

(22) PCT Filed: Nov. 3, 2020

(86) PCT No.: PCT/EP2020/080760
§ 371 (c)(1),
(2) Date: Apr. 25, 2022

(87) PCT Pub. No.: WO2021/155967
PCT Pub. Date: Aug. 12, 2021

(65) Prior Publication Data

US 2022/0371317 A1 Nov. 24, 2022

(30) Foreign Application Priority Data

Feb. 3, 2020 (DE) ..... 10 2020 102 622.6

(51) Int. Cl.
*B41F 9/06* (2006.01)
*B41F 9/10* (2006.01)
*B41F 31/26* (2006.01)

(52) U.S. Cl.
CPC ..... *B41F 9/063* (2013.01); *B41F 9/1081* (2013.01); *B41F 31/26* (2013.01)

(58) Field of Classification Search
CPC ..... B41F 9/063; B41F 9/1081; B41F 31/26
See application file for complete search history.

(56) References Cited

U.S. PATENT DOCUMENTS 4,604,951 A 8/1986 Ichikawa et al.
5,840,386 A 11/1998 Hatch et al.
2021/0178748 A1* 6/2021 Jufer ..... B41F 9/1027

FOREIGN PATENT DOCUMENTS

CN 101544098 B 6/2012
DE 9705080 T2 10/2001
(Continued)

OTHER PUBLICATIONS

International Search Report of PCT/EP2020/080760 dated Feb. 10, 2021.

*Primary Examiner* — Matthew G Marini
*Assistant Examiner* — Leo T Hinze
(74) *Attorney, Agent, or Firm* — Mattingly & Malur, PC

(57) ABSTRACT

In some examples, a gravure printing unit for printing onto a substrate includes a forme cylinder that has, on an outer circumference, a pattern of recesses for forming an image. The gravure printing unit further includes an inking unit for inking the pattern of recesses on the forme cylinder. The inking unit includes a first inking unit cylinder having line-like recesses on an outer cylindrical surface that correspond to line-like recesses of the pattern of recesses on the outer circumference of the forme cylinder. Two end-aligned line-like recesses on the outer cylindrical surface of the first inking unit cylinder are separated by a supporting ridge and correspond to a single uninterrupted line-like recess on the circumference of the forme cylinder. An upper surface of the supporting ridge lies at a level of an undisrupted region of the outer cylindrical surface of the first inking unit cylinder.

21 Claims, 8 Drawing Sheets

(56) References Cited

FOREIGN PATENT DOCUMENTS

| | | | |
|---|---|---|---|
| DE | 102013217942 | A1 | 3/2015 |
| EP | 0384897 | A1 | 8/1990 |
| EP | 0813962 | A2 | 12/1997 |
| EP | 1995062 | A1 | 11/2008 |
| EP | 02909033 | B1 | 9/2017 |
| GB | 626200 | A | 7/1949 |
| WO | 200220268 | A1 | 3/2002 |
| WO | 2004069538 | A2 | 8/2004 |
| WO | 2005077656 | A | 8/2005 |
| WO | 2020161056 | A1 | 8/2020 |

* cited by examiner

GRAVURE PRINTING UNIT WITH INKING UNIT CYLINDERS

CROSS-REFERENCES TO RELATED APPLICATIONS

This application is the US national phase, under 35 USC § 371, of PCT/EP2020/080760, filed on Nov. 3, 2020, published as WO 2021/155967 A1 on Aug. 12, 2021, and claiming priority to DE 10 2020 102 622.6, filed Feb. 3, 2020, the disclosures of which are expressly incorporated by reference herein in their entireties.

TECHNICAL FIELD

Some examples relate to a gravure printing unit for printing onto a substrate according to a gravure printing method. The gravure printing unit includes a forme cylinder, which, on its circumference, has an image-forming pattern of recesses, and further includes an inking unit for inking the pattern of recesses provided on the forme cylinder. The inking unit includes a first inking unit cylinder, which, in the region of its outer cylindrical surface, includes recesses that correspond to recesses on the forme cylinder. The inking unit further includes an inking device by means of which the first inking unit cylinder can be inked at an application point located on its circumference, and a second inking unit cylinder, which cooperates with the first inking unit cylinder. The inking device, on at least the downstream side of the application point in the operating direction of rotation of the first inking unit cylinder, includes a retaining means, which is formed by a wiping means that, at least in the operating position, is in physical contact with the outer cylindrical surface of the first inking unit cylinder and configured as a doctor blade, which can be used to remove printing ink that has been applied to non-engraved regions.

BACKGROUND

EP 2 909 033 B1 discloses an intaglio printing press having a printing unit in which a plate cylinder configured as a gravure cylinder is inked indirectly via an ink collecting cylinder. Said ink collecting cylinder receives the printing ink via multiple chablon rollers, which are in turn inked by inking devices. In one embodiment, the inking is carried out by two ink application rollers, which receive the ink via a duct roller that cooperates with an ink fountain. In another embodiment, an ink transfer roller is additionally provided between duct roller and chablon roller.

U.S. Pat. No. 4,604,951 A discloses an intaglio printing press comprising a plate cylinder that carries a printing plate, an application roller that is in rolling contact with the plate cylinder and has on its circumference a structure of ink-transferring raised areas, and an inking device, which comprises a duct roller and is in rolling contact with the application roller. The duct roller has essentially the same circumference as the application roller and, on its outer circumference, has recesses of different depths that correspond to the recesses on the printing plate. During printing, a distance of 0.03 to 0.05 mm between the duct roller and the ink blade is set. Further provided is an adjustment mechanism for positioning the structured duct roller in relation to the plate cylinder in the circumferential direction and in the axial direction.

Known from WO 2005/077656 A1 is an inking system of an intaglio printing press, in one embodiment of which the gravure printing plate is inked directly by a chablon roller, which is in turn inked by a selective inking cylinder. Printing ink is applied to the circumferential surface of the latter by a spraying device, with the excess ink being removed by means of a wiping roller prior to contact with the chablon roller. In the remaining embodiments, the gravure printing plate is inked indirectly via a transfer or collecting cylinder, which is inked via one or more chablon rollers, which is or are in turn inked by a selective inking cylinder. Printing ink is applied to the circumferential surface of the latter by a spraying device or a duct roller cooperating with an ink fountain, with the excess ink once again being removed by means of a wiping roller prior to contact with the chablon roller.

CN 101544098 B relates to a duct roller, an ink transfer device, and an ink transfer system of a gravure printing press. The ink is transferred from an ink reservoir via a duct roller, which has engraving on its circumference that corresponds to the engraving on the gravure cylinder, to an elastic inking roller and from there to the gravure cylinder. During application of the ink to the duct roller, the outer surface of said roller is in physical contact with a hook-shaped scraper for scraping the ink off of the non-engraved areas. In this way, rather than a uniform layer of ink, an ink pattern of varying thickness, similar to the form of a relief, that corresponds to the pattern of engravings on the gravure cylinder is applied to the elastic inking roller. The contact pressure on the outer cylindrical surface can be adjustable via an adjustment device.

WO 02/20268 A1 relates to a way for further increasing protection against forgery of images printed by recess printing. For this purpose, a fine structure is superimposed on the line pattern on the recess printing unit. Such a fine structure may be provided by a structure that splits the engraving line longitudinally into a double line, but also by symbols, text or geometrical figures. This is made possible in that an original underlying the line structure to be generated is provided on the monitor, assisted by data processing. There, individual lines can be modified in terms of their shape or by way of the fine structure, and the digital image data thus created can then be stored and supplied to a precision engraving device.

EP 0 813 962 A2 relates to a device for filling recesses of a cylinder of a printing press, e.g., of an anilox roller or of a forme cylinder, using a doctor blade device. The latter can be made to oscillate, i.e., to move back and forth axially, by a working cylinder.

DE 10 2013 217 942 A1 relates to an Orlof gravure printing unit, wherein the Orlof plate cylinder is radially adjustable.

DE 697 05 080 T2 describes a sleeve and a method for producing a liquid transfer roll, in particular for an anilox roller including a continuous engraving, or a gravure printing roller engraved with a certain pattern, which comprises an expandable inner skin, a compressible intermediate layer, and a self-supporting, metal tube.

SUMMARY

It is an object of the invention to devise a gravure printing unit.

The object is achieved by a gravure printing unit in which line-like recesses on the first inking unit cylinder that correspond to continuous line-like recesses on the forme cylinder comprise at least one supporting ridge, which interrupts the recess on the first inking unit cylinder that corresponds to the continuous line-like recess on the forme cylinder, and the upper surface of which lies at the level of the undisrupted, i.e., non-engraved, outer cylindrical surface of the first inking unit cylinder.

The advantages to be achieved with the invention are, in particular, that, under stable conditions, the consumption of printing ink can be reduced by way of the printing unit to a particularly low level and/or that print images that have particularly fine image structures, particularly with respect to a resolution in relation to coloration and/or with respect to an ink density or ink intensity, can be achieved, without the quality declining unnecessarily quickly and/or unnecessarily frequent interruptions being required due to a make ready operation as a result of wear.

A gravure printing unit according to the invention, in particular an intaglio printing unit, for printing onto substrate by a gravure printing method, in particular an intaglio method, comprises a forme cylinder, which has on its circumference an image-forming pattern of recesses, and an inking unit for inking the pattern of recesses provided on the forme cylinder, the inking unit comprising a first inking unit cylinder, which has recesses in the region of its outer cylindrical surface that correspond to recesses on the forme cylinder, an inking device by means of which the first inking unit cylinder can be inked at an application point located on its circumference, and a second inking unit cylinder, which cooperates with the first inking unit cylinder and has, in the region of its outer cylindrical surface, elevations, in particular ink-transferring elevations, that correspond to recesses on the forme cylinder, or raised areas that correspond to areas, comprising the recesses, of the image-forming pattern of recesses on the forme cylinder.

According to a first particularly advantageous embodiment, recesses on the first inking unit cylinder that correspond to continuous, i.e., uninterrupted, recesses on the forme cylinder have at least one supporting ridge, which interrupts the recess on the first inking unit cylinder that corresponds to the continuous recess on the forme cylinder and, with the exception of the interruption by the at least one supporting ridge, otherwise is in particular likewise line-like, and the upper surface of which lies at the level of the undisrupted, i.e. non-engraved, outer cylindrical surface of the first inking unit cylinder.

This has the advantage that the doctor blade edge cannot dip, or dips less, into the recesses when passing over the recesses, which otherwise could cause damage to the doctor blade.

The term "line-like" or "line-shaped" shall be understood to refer here not only to lines that have narrow line widths, but also to strip-like lines having greater line widths, with a length in particular being greater than a width in each case, in particular a length being significantly greater, i.e., at least twice or preferably at least four times or even ten times as large as a width of the line having a constant line width or a largest width of a line having a varying width. Although in a preferred embodiment of the "line-like" recess or elevation the thickness of the line is unchanged over its length, in the broader sense this embodiment could also include wedge-like structures or structures having a varying width.

In an advantageous embodiment, the supporting ridges are superimposed on the pattern of recesses on the gravure inking cylinder in a regular structure. The supporting ridges are preferably provided along an open line structure, in particular along wave structures that run in opposite directions or in the same direction, or, in particular along lines that run rectilinearly and parallel to one another.

In an advantageous embodiment, rectilinear and parallel supporting ridges that are superimposed on lines are spaced apart by 300 to 700 μm and/or run at an incline of 20° to 40° (twenty degrees to forty degrees) in relation to a line that runs parallel to the axis of rotation of the gravure inking cylinder on the outer cylindrical surface and/or have a ridge width at the level of their surface of 30 to 50 μm.

In an advantageous refinement of the gravure printing unit, at least the retaining means, or an ink supply unit that supports it and is mounted axially movably in the inking device, can be moved axially by a drive means, in terms of the axial position relative to the inking unit cylinder that includes the recesses, and/or can be oscillated during operation.

During the removal of excess printing ink, an oscillating retaining means, for example, can effect a more even, wear-induced removal, especially in the case of a doctor blade that is set against a cylinder during operation, and can thereby contribute to a more stable operation.

In an advantageous refinement, a positioning drive comprising a remotely actuatable drive means is provided, by means of which the doctor blade, an ink supply unit comprising the doctor blade and at least the parts that delimit the ink supply chamber, or the entire inking device can be set against and moved away from the outer cylindrical surface, and/or can be varied in terms of the force with which it is set against said surface, and/or which repositions the doctor blade, the ink supply unit, or the entire inking device when the operative end of the doctor blade becomes shortened due to wear.

A positioning drive by means of which the retaining means, which is in particular embodied as a doctor blade, is repositioned automatically and/or continuously during operation, for example, contributes to constant conditions in the region of ink infeed.

The first inking unit cylinder has, in the region of its outer cylindrical surface, recesses that correspond to the first recesses on the forme cylinder and that, in an advantageous embodiment, have a width that is greater by at least 40 μm and/or no more than 400 μm than that of the corresponding recesses on the forme cylinder.

In an advantageous refinement, the recesses on the first inking unit cylinder are provided on the outer circumference of an ink transfer forme sheath that is circumferentially closed and/or on a ceramic or metallic outer layer of the inking unit cylinder or of the ink transfer forme sheath.

The aforementioned aspects and other aspects that may arise, e.g. in the following description can contribute, individually or in groups, to realizing a selective ink infeed of sufficient quality in the printed product and/or to stable production.

Particular advantages of an aforementioned printing unit are realized in a printing press configured as a security printing press and/or as a printing press for processing sheet-format substrate and/or as a gravure printing press operating according to the intaglio method, which comprises a substrate infeed, by which the substrate to be printed can be fed into the printing press on the input side, a first conveyor line by which the substrate can be fed to the at least one printing unit, a second conveyor line by which the substrate can be fed directly or indirectly to a product receiving unit, by means of which the substrate, which has been printed on at least one side, can be combined into bundles.

Further variant embodiments, refinements, and details may be derived individually or in combinations in the following description and in the dependent claims.

BRIEF DESCRIPTION OF THE DRAWINGS

Exemplary embodiments of the invention are illustrated in the drawings and will be described in greater detail below. The drawings show.

DETAILED DESCRIPTION

Figure 1A:
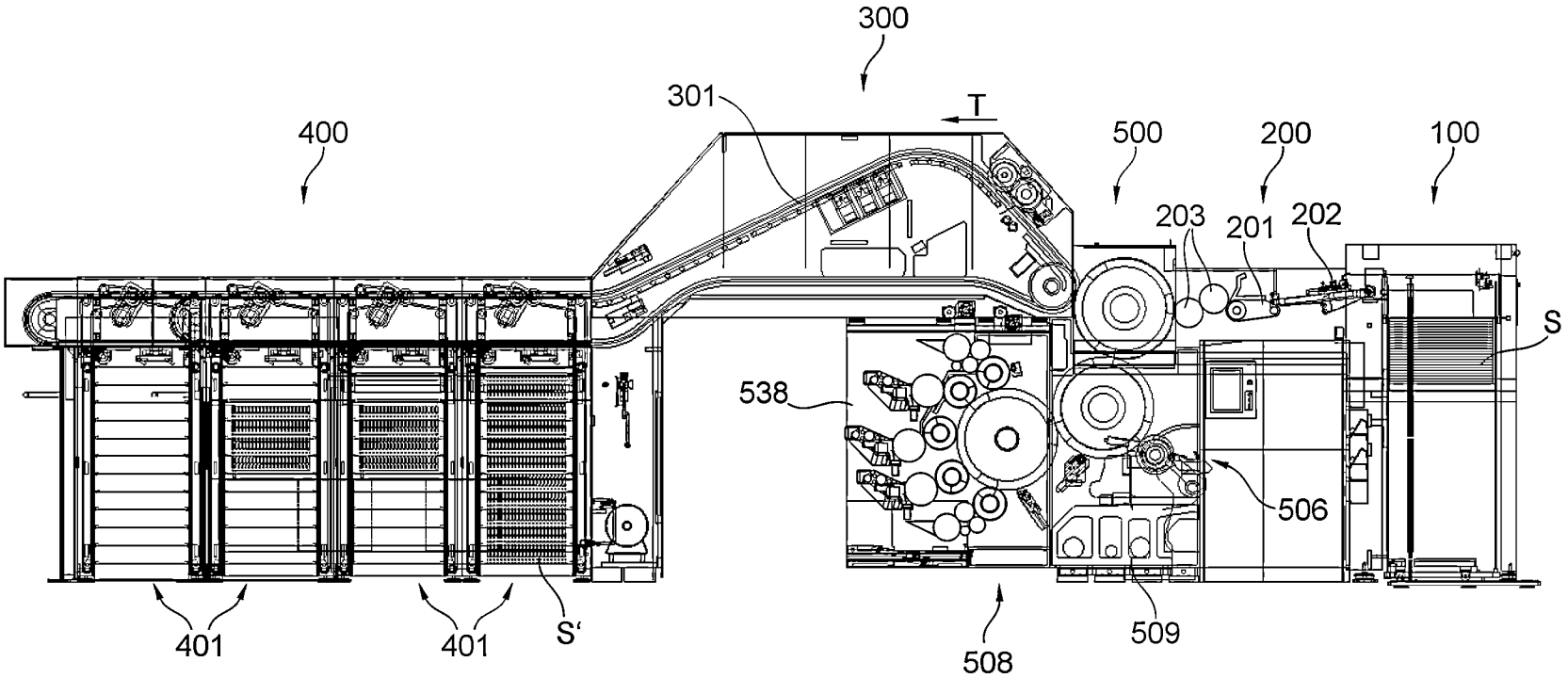
FIG. 1*a* a side view of a printing press, in particular a gravure printing press in a first embodiment.

A printing press, in particular a security printing press, comprises at least one printing unit 500, by means of which substrate S can be printed at least by a gravure printing method, a substrate infeed 100, for example, by which the substrate S to be printed can be fed to the printing press on the input side, a first conveyor line 200 by which the substrate S can be fed to the at least one printing unit 500, a product receiving unit 400 by which the substrate S' that has been printed on at least one side can be combined into bundles, and a second conveyor line 300 by which the substrate S' can be fed, optionally via additional processing units, to the product receiving unit 400.

The printing press is configured, e.g. as a sheet-fed printing press, in particular as a sheet-fed gravure printing press, preferably as a sheet-fed printing press that prints in an intaglio printing process. The intaglio printing process is a gravure printing process that is preferably used for the industrial production of banknotes, security documents, or security elements.

Figure 1B:
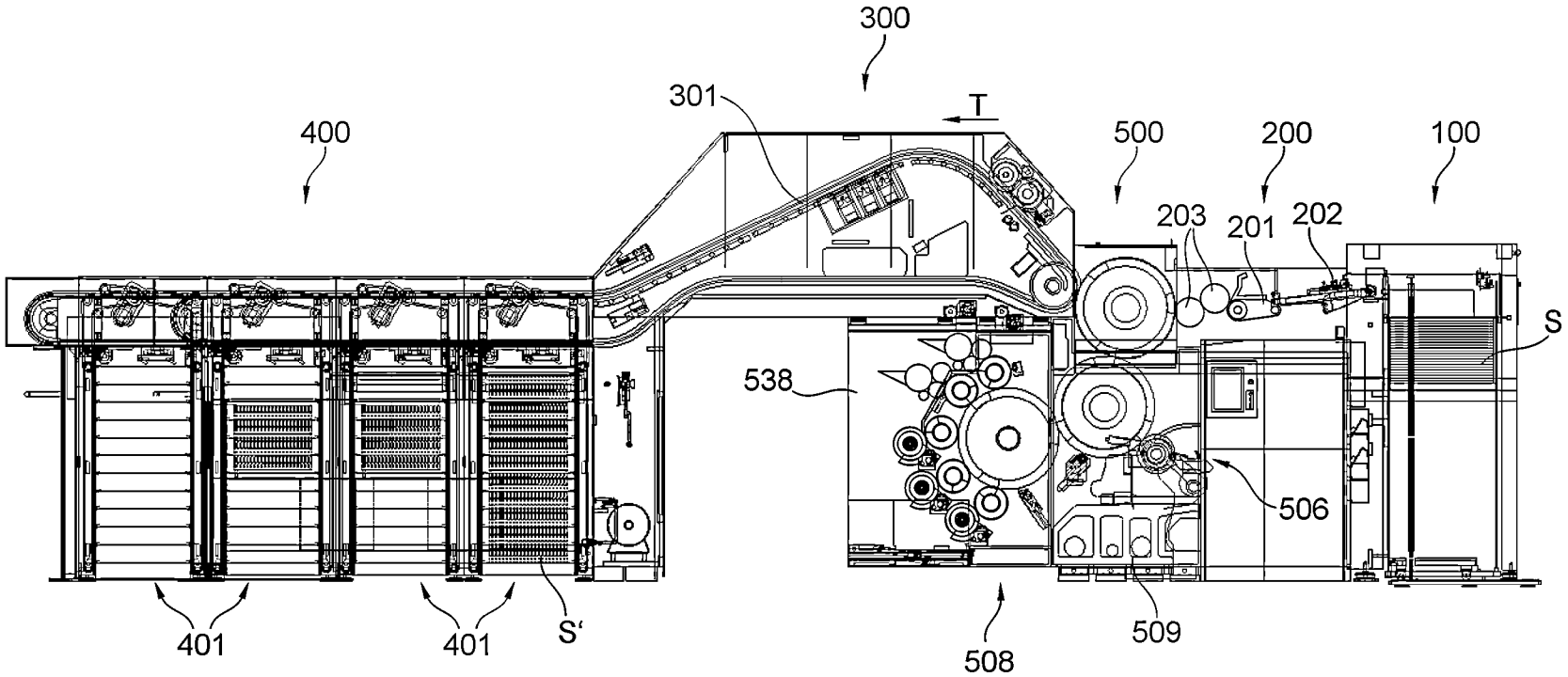
FIG. 1*b* a side view of a printing press, in particular a gravure printing press in a second embodiment.

The printing press, which preferably prints by a gravure printing process, in particular in an intaglio printing process, in a preferred embodiment as a sheet-fed printing press comprises the at least one printing unit 500 that operates according to a gravure printing process, in particular an intaglio printing process, along with preferably at least one substrate infeed 100 embodied as a sheet feeder 100, by means of which a substrate S to be printed, in the form particularly of stacked substrate sheets S, e.g. printing substrate sheets S, in particular security paper sheets S, is or at least can be provided on the input side of the printing press. The edges of the rectangular substrate sheets S measure, e.g., between 475×450 mm and 700×820 mm; the grammage of the substrate sheets S is, e.g., between 70 g/m$^2$ and 120 g/m$^2$. The printing press further comprises, as part of the first conveyor line 200, a sheet infeed 201, by means of which substrate sheets S furnished at the sheet feeder 100 are or at least can be fed, e.g. via conveying means 202 and/or one or more transfer drums 203, to the first printing unit or to a first printing unit 200 of the printing press in series, i.e. individually in succession. A rocking gripper system is preferably provided for transferring the substrate sheets S to the first transfer drum 203. Downstream of the last printing unit or a last printing unit 500, the printing press further comprises, e.g. a transport device 301 comprised by the second conveyor line 300, configured, for example, as a revolving conveyor belt or as a revolving chain system, in particular a chain gripper system, to which the substrate sheets S' that have been printed at least by the printing unit 500 are transferred directly or via at least one or more intermediate cylinders comprised, e.g., by the second conveyor line 300, wherein substrate sheets S' that have been transferred to the transport device 301 are or at least can be transported by means of said device to a processing unit downstream or to a product receiving unit 400, configured as delivery 400, in this case pile delivery 400, e.g. multi-pile delivery, where they are or at least can be deposited. In the embodiment of FIGS. 1*a* and 1*b*, the pile delivery 400 comprises, e.g., four piles or pile spaces 401 arranged one behind the other, as viewed in the transport direction T of the substrate sheets S; S'. In the region of the transport device 301, an e.g. optoelectronic, preferably camera-based inspection system (not denoted) may be provided, by means of which the quality of the printed substrate sheets S' is or at least can be checked. The substrate sheets S' are inspected particularly to ensure that they are free of defects as compared with a designated master. Depending on the results of this inspection, the substrate sheets S' are then deposited on a designated pile in the multi-pile delivery.

In the case of a printing press configured as a web-processing press, the printed images of a certain printing length are or will be formed not as substrate sections S; S' formed by substrate sheets S; S' but as substrate sections S; S' formed by repeating lengths arranged in a row, which are then or can then be wound to form a product roll or cut into substrate sheets S; S' and stacked.

Generally, the at least one printing unit 500 operating according to a gravure printing method can be provided with one or more additional printing units operating by the same printing method or by different printing methods in the first and/or second conveyor line 200; 300.

The printing unit 500 operating by a gravure printing method, in particular an intaglio printing method, hereinafter also referred to as gravure printing unit 500, in particular as recess printing unit 500 or intaglio printing unit 500, comprises at least one printing unit cylinder 501 also acting and/or designated as impression cylinder 501 and a printing unit cylinder 503 that forms a printing nip 502 with the impression cylinder 501 and is embodied as a forme cylinder 503 for gravure printing, in particular intaglio printing cylinder 503, wherein the impression cylinder 501 and the forme cylinder 503 preferably are or at least can be thrown onto one another under high pressure. In the embodiment as a printing press for processing sheet-format substrate S; S', the impression cylinder 501 preferably comprises on its circumference one or m axially extending cylinder channels, each having a holding means, e.g. a gripper bar, by means of which the sheet-format substrate S resting on impression cylinder 501 can be conveyed through the printing nip 502. On its circumference, the forme cylinder 503 carries one or more printing forms 504 having a pattern of recesses 514 that form the basis of the print image to be printed, e.g. motif, hereinafter also referred to synonymously, where not explicitly otherwise specified, as "engravings" 514, regardless of their method of production. Unless explicitly distinguished, said printing forme 504, in particular gravure printing forme 504, is to be understood both as an outer circumferential surface of the cylinder itself that comprises the recesses 514 or engravings 514 and in a preferred embodiment as a printing forme 504 that comprises the recesses 514 or engravings 514 and is or can be detachably arranged on the forme cylinder 503, e.g. as a printing plate 504 or optionally as a printing forme sheath. Forme cylinder 503 is preferably configured as "multiple sized", e.g. m-sized, (with m∈ℕ [≤5, especially m [3), e.g. triple-sized, and is configured to accommodate m, e.g. m=3, printing formes 504 in a row and/or for printing m, e.g. m=3, print lengths, in particular for accommodating and/or printing multiple, e.g. m=3, substrate sheets S per revolution. The engravings 514 are preferably provided in an outer metal layer of the printing forme 504, which is or has been coated with a hard metallic material, in particular with chrome, after the engravings 514 are applied.

Preferably, the printing unit 500 or the printing press for printing the substrate S, in particular the substrate sheet S, is configured with multiple copies. The overall image applied to a printing length or repeat length and/or assigned to a substrate sheet S; S' or substrate section S; S' is preferably formed by the print images of a plurality of copies $N_i$, e.g. banknotes $N_i$, to be printed in multiple columns side by side and in multiple rows one after another onto the substrate S. The engraving pattern of a printing forme 504 assigned to the printing length is therefore formed by a corresponding multiplicity of patterns of recesses, e.g. motif engravings, in particular with the identical motif, arranged in matrix form in columns and rows. Generally, a number of first rows or columns containing a plurality of first patterns of recesses 514 of first copies $N_i$, e.g. banknotes of a first currency and/or a first value, and a number of second rows or columns containing a plurality of second patterns of recesses 514 of second copies $N_i$, e.g. banknotes of a second currency, can also be comprised on a printing length or printing forme 504.

The print image to be printed by the printing unit 500 can generally comprise a single image motif that extends, e.g. over the entire printing width and length, i.e. over one substrate section S; S'. In the case that is preferred here, however, which involves printing a plurality of copies $N_i$ per substrate section S; S', the same image motifs are printed onto each of at least a plurality of copies $N_i$, preferably onto all copies $N_i$. Such an image motif may be a spatially isolated print image region with complete image information, as is found in portraits, cultural sites, objects of daily use, landscape details, or the like. Alternatively, the image motif may be composed of alphanumeric information or of a regular or irregular pattern, e.g. without actual meaningful representational content. An image motif may also be a combination of the aforementioned characteristics. In a particularly advantageous embodiment, the image motif to be printed in the gravure or intaglio printing method can be a security feature or a portion of such a feature, which is, for example, by a particularly high resolution in terms of the ink intensity and/or ink density of lines or print elements, in particular raised, that are applied in the gravure or intaglio printing process. It is also possible for a plurality of such image motifs, spatially separated from one another, to be provided per copy $N_i$.

To remove excess ink, a removal device 506, e.g. a wiping device 506 with a wiping cylinder 507, is or at least can be set against the forme cylinder 503. The wiping cylinder 507 is coated on its outer cylindrical surface, e.g. with a plastic.

The forme cylinder 503 or a printing forme 504 provided thereon can be inked with one or preferably with multiple inks by an inking unit 508. Said inking unit 508 can be mounted such that it can be moved as a whole or in sections away from the preferably stationary printing unit part 509, which comprises the printing unit cylinders 501; 503 that form the printing nip 502, and/or can even be configured as separable therefrom.

The inking unit 508 comprises, at its upstream end as viewed in the direction of ink transport within the inking unit 508, an inking device 511, which is or can be supplied with printing ink 517 by an ink feed system, for example, and by means of which an inking unit cylinder 512, e.g. a first inking unit cylinder, can be inked. Said inking unit cylinder 512 comprises recesses 513 in the region of its outer cylindrical surface 518, hereinafter also referred to synonymously, where not explicitly specified, as "engravings" 513, regardless of their method of production, which correspond to the engravings 514 or to a portion of the engravings on the printing forme 504 of the forme cylinder 503. This does not mean that they must have the same dimensions and the same depth z as the corresponding engravings 514, but that their shape and/or depth z are in a defined relationship with respect to one another that will be or is obtained, for example, based on regularities that are established or are to be established, or that the recesses 513 or engravings 513 on the gravure inking cylinder 512 have a size that is scaled by way of a defined regularity and/or a shape in relation to the respective corresponding recesses 514 or engravings 514 on the forme cylinder 503. Preferably, for engravings 513 on the inking unit cylinder 512, a greater width b513, e.g. than line width b513, and/or a greater depth z is provided than for the corresponding engravings 514 on the forme cylinder 503 or the printing forme 504 comprised or carried by the same.

For at least some of the recesses 514 on the forme cylinder 503, for example, corresponding recesses 513 on the gravure inking cylinder 512 are greater on all sides of the recess 513, for example, by at least 20 μm and/or by no more than 200 μm, advantageously by at least 50 μm and/or no more than 150 μm, in particular by 80 to 120 μm, preferably by 100±5 μm than the corresponding recesses 514 on the forme cylinder 503. Thus, for at least some of the recesses 514 on the forme cylinder 503, a width b513 or line width b513 on the gravure inking cylinder 512 is greater, e.g., by at least 40 μm and/or no more than 400 μm, advantageously by at least 100 μm and/or no more than 300 μm, in particular by 160 to 240 μm, preferably by 200±10 μm, than that of the corresponding recess 514 on forme cylinder 503. Narrow line structures on the printing forme 504 can in some cases merge to form larger engraved areas, for example, on the inking unit cylinder 512 comprising the engravings 513. When there is a partial merging of engravings 513, e.g. two or more such partially contiguous recesses 513 are contiguous due to an aforementioned larger size as compared with the recesses 514 on the forme cylinder 503 and e.g. only narrow spacing, and the recesses 513 are perceptible at least on a non-merged longitudinal section, for example. There may also be areas of recesses 513 that are merged in this way, so that as a result of the larger size and due to a high line density on the forme cylinder 503, individual recesses 513, e.g. in the interior of such an area, are no longer perceptible in isolation. Nevertheless, in the following such overlapping recesses 513 on the gravure inking cylinder 512, which in this case are overlapping due to the transfer of the individual recesses 514 on the forme cylinder 503 in accordance with a regularity, are likewise regarded as corresponding to recesses 514 on the forme cylinder 503.

For the sake of simplicity, the inking unit cylinder 512 that comprises the recesses 513 configured as engravings 513 is also referred to synonymously, where not explicitly specified, as "gravure inking cylinder" 512, regardless of the method by which the recesses 513 are produced.

The outer diameter of gravure inking cylinder 512 is preferably in a ratio of 1:n to the outer diameter of the forme cylinder 503, with n∈ℕ<10, in particular n=1, 2 or 3.

By means of the inking device 511, the first inking unit cylinder 512, which comprises recesses 513 in the region of its outer cylindrical surface 518 that correspond to recesses 514 on the forme cylinder 503, can be inked at an application point lying on its circumference. In this context, the "application point" shall also be understood as a circumferential section, extending in the circumferential direction, in which ink is applied to the first inking unit cylinder 512 by the inking device 511 and/or in which the cylinder comes into contact with a supply of printing ink 517. Ink can generally be applied at the application point as desired.

Figure 3A:
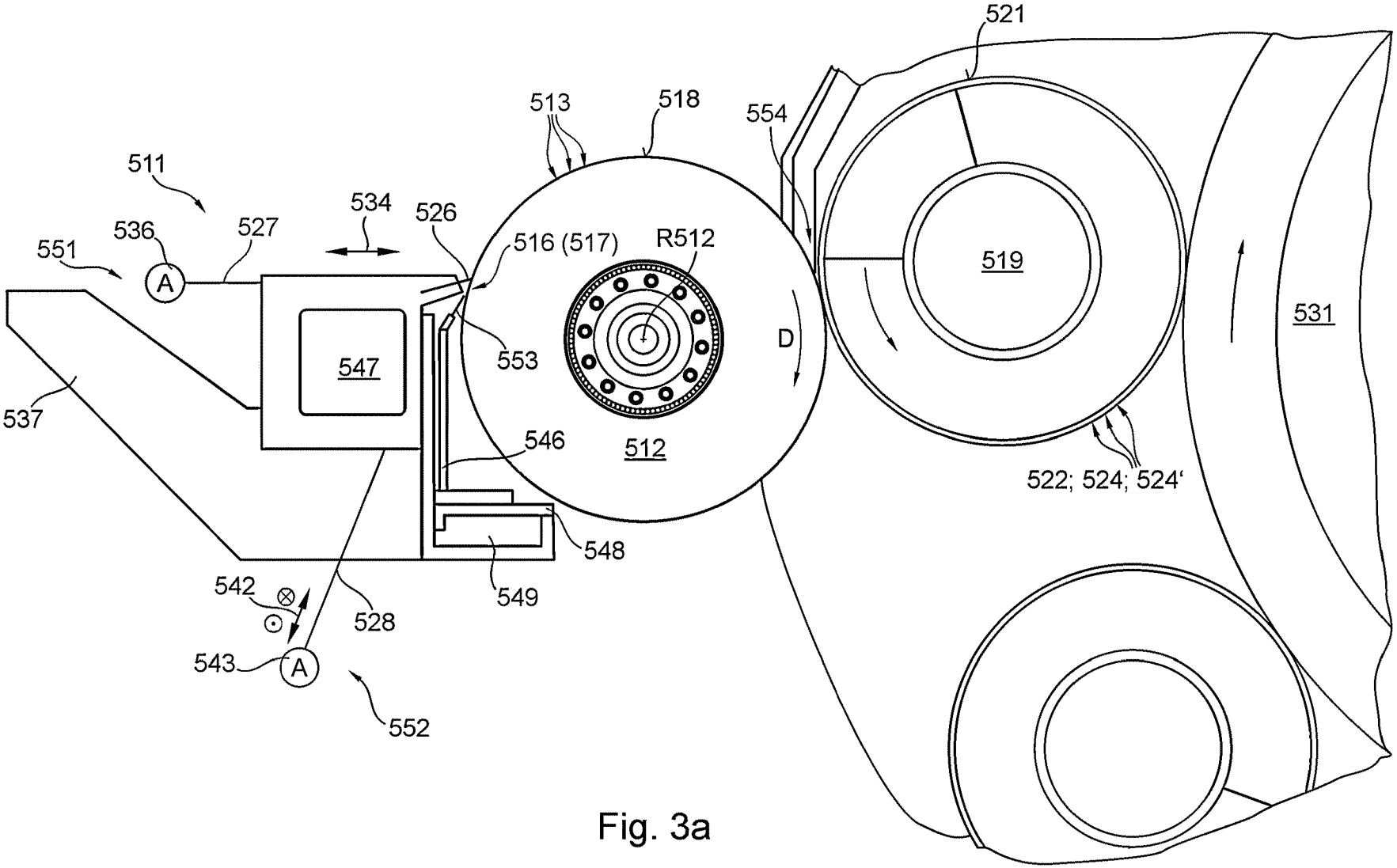
FIG. 3*a* an enlarged detail of the printing unit according to FIG. 2*a;*
Figure 3B:
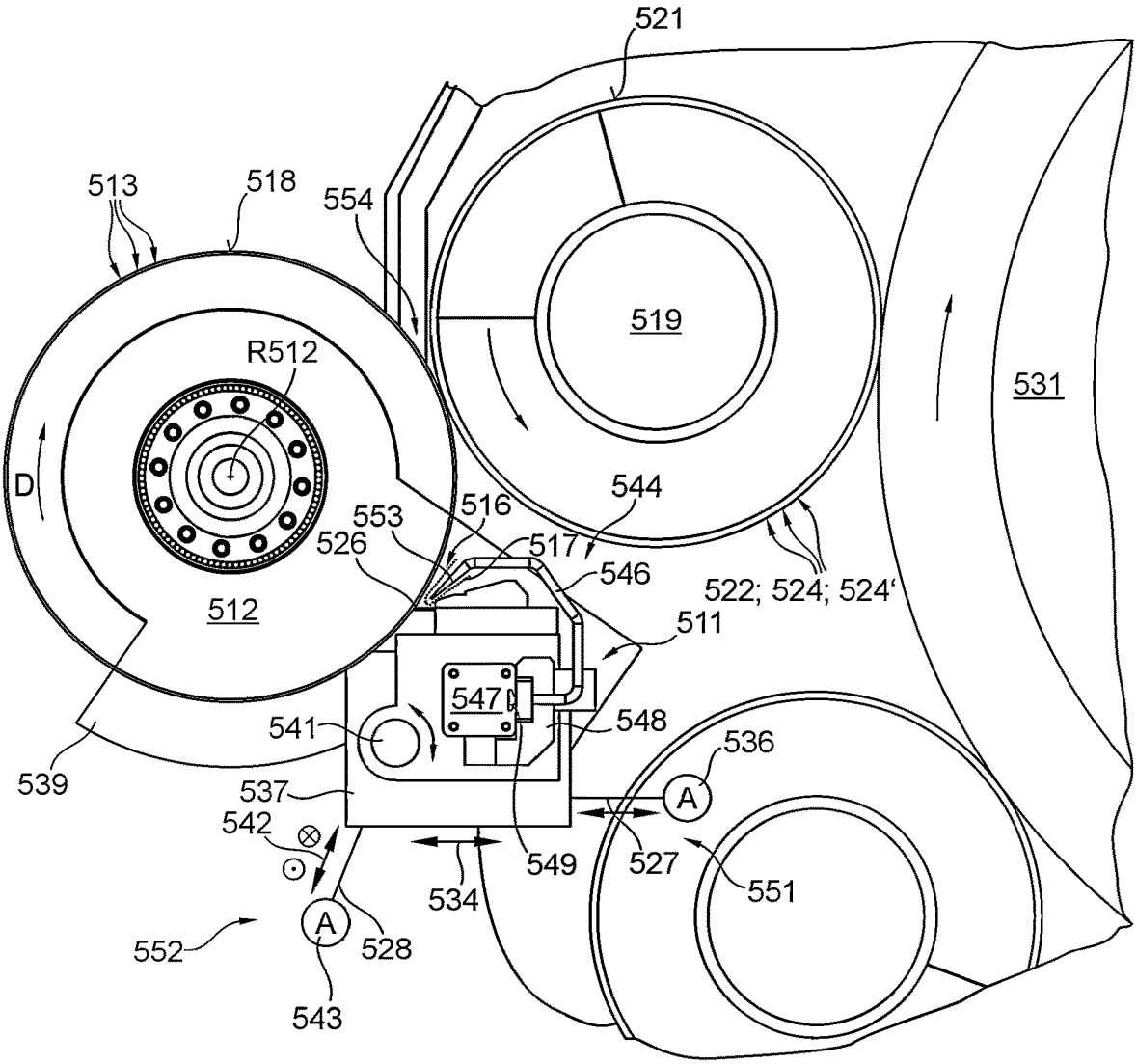
FIG. 3*b* an enlarged detail of the printing unit according to FIG. 2*b;*

In a preferred embodiment, the inking device 511 for inking the gravure inking cylinder 512 comprises an ink supply chamber 516, which is at least partially delimited on the side facing the gravure inking cylinder 512 by the outer cylindrical surface 518 thereof (see, e.g., FIGS. 3*a* and 3*b*). Leading or protruding into the ink supply chamber 516, for example, e.g. centered in the axial position thereof, is the opening of at least one stationary or axially moved ink feed line, via which the amount of printing ink 517 consumed is or can be replaced in the ink supply chamber 516. The ink supply chamber 516 is understood here, e.g. generally as the space in which the printing ink 517 to be applied and which is in contact with the outer cylindrical surface 518 is located. Depending on the embodiment, this may be an ink supply chamber 516 that is open toward the top, open toward the bottom, or closed at the top and bottom.

The engravings 513 or recesses 513 of the inking unit cylinder 512 are, for example, recesses having a depth z (513) of, for example, no more than 0.3 mm, in particular no more than 0.2 mm, in relation to the non-engraved outer cylindrical surface region.

Downstream of the gravure inking cylinder 512 in the inking unit 508, an inking unit cylinder 519, e.g. a second inking unit cylinder, to be inked by said gravure inking cylinder is provided, which has, in the region of its preferably elastic and/or compressible outer cylindrical surface 521, elevations 522; 524; 524' separated from one another by deeper points or areas, configured to cooperate in the region of these elevations 522; 524; 524' with the outer cylindrical surface of the next inking unit cylinder or printing unit cylinder 531; 503 downstream. Ink is then transferred, e.g. only in the region of these elevations 522; 524; 524'. Ink is then transferred, e.g. only in the region of these elevations 522; 524; 524'. The elevations 522; 524; 524' provided for ink transport lie with their upper surface in an outer cylindrical surface, which represents the cylinder diameter of the inking unit cylinder 519 that is effectively used for printing.

In a first embodiment, the elevations 522; 524; 524' can be raised areas 522, which correspond to engraved areas 523 of the printing forme 504 to be inked. These engraved areas 523 are assigned, for example, to the individual image motifs and, in a first embodiment for monochrome image motifs, for example, cover the entire surface area of the image motif or the engravings 514 relating to said image on the forme cylinder 503. Such elevations 522 are, for example, areas 522 having a surface area that extends over an image motif composed of a multiplicity of engravings 514, e.g. more than 100, provided on the forme cylinder 503 and/or are elevations 522 that are spaced apart from one another and that extend over spatially separate, in particular not interwoven image motifs, as is known, for example, from the prior art.

In an embodiment that is generally advantageous on its own, but is particularly advantageous in conjunction with the gravure inking cylinder 512 and/or a multicolor printing process, the engravings 514 on the inking unit cylinder 519 for the same image motif provided on the forme cylinder 503 are assigned a raised area 522, the surface area of which is smaller than that of the image motif, or an elevation 522 that does not extend over all engravings 514 that relate to the same image motif, and are provided on the inking unit cylinder 519. An area 522 of this type extends, for example, over an uninterrupted surface area or a closed region of recesses 514 on the forme cylinder 503 that are to be inked via the same gravure inking cylinder 512 or that belong to a part of an image motif to be inked with the same ink, in particular irrespective of the line density present there. In such an embodiment, e.g. one or more areas 522, each having a maximum diameter of less than 50 mm, are provided on a gravure inking cylinder 512.

In an advantageous embodiment, the elevations 522; 524; 524' that relate to or cover the entirety of the engravings 514 of the same image motif are provided on multiple different inking unit cylinders 519 of the printing unit 500, e.g. configured as a multicolor printing unit 500, in particular such that they cover the entirety of the engravings 514 of the image motif on the forme cylinder 503. In that case, one or a plurality of non-contiguous elevations 522; 524; 524' assigned to the same image motif may be provided on the same inking unit cylinder 519 and may, e.g., ink the engravings 514 of image parts of the same color.

The aforementioned areas of elevations 522 are, e.g. areas 522 that each extend over only a part of an image motif or over only some of the recesses 514 relating to the image motif, wherein another part of the same image motif or the recesses 514 relating to the image motif is or will be covered by one or more respective elevations 522 on another gravure inking cylinder 512 of the printing unit 500. When rolled off onto the forme cylinder 503, these elevations 522 of the same image motif provided on different inking unit cylinders 519 relate to mutually adjacent, for example at least partially interwoven and/or interpenetrating parts of the same image motif or of the associated engravings 514. Areas 522 of multiple inking unit cylinders 519, e.g. two, three, four or even five, may be assigned to one copy $N_i$ or to one image motif provided on the surface of one copy $N_i$.

In a particularly advantageous embodiment, however, elevations 524; 524' that correspond to engravings 514, especially individual engravings (i.e., individual dot-like, area-like, or preferably line-like engravings 514, for example) of the forme cylinder 503 or the printing forme 504 are provided on the outer cylindrical surface 521, e.g. in the manner of a relief with point-like, area-like, or preferably line-like ridges 524; 524', which correlate in terms of shape and surface area, e.g. as viewed in a plan view and/or when rolled out, to the shape and/or surface area of the respective recess 514. Here again, the latter does not mean that the elevations 524; 524' must have the same dimensions in terms of surface area as the corresponding engravings 514, but that their shape has a defined relationship to the shape of the corresponding engraving 514 of the printing forme 504, which will be or is also obtained here, for example, based on regularities that are or will be determined. Ridges 524; 524' that correspond to multiple adjacent engravings 513 as set out below can then merge to form a larger structure of an elevation 524'; however, due to the underlying regularity, the periphery will correspond, e.g. to the underlying engravings 513. For the sake of simplicity, the inking unit cylinder 519 comprising the raised areas 522 and/or elevations 524; 524' is also referred to synonymously, unless explicitly otherwise specified, as "relief inking cylinder" 519, regardless of the nature and configuration of the elevations 524; 524'. Elevations 524; 524' on the relief inking cylinder 519 that correspond to engravings 514 on the forme cylinder 503 preferably have a greater width b524 than the width b514 or line width b514 of corresponding engravings 514 on the forme cylinder 503 or the printing forme 504. As mentioned above, for narrow line structures on the forme cylinder 503 or on the printing forme 504, for example, individual, e.g. corresponding elevations 524 on the relief inking cylinder 519 can merge partially or completely to form larger elevations 524'. If elevations 524; 524' are only partially merged, two or more partially contiguous elevations 524; 524' are connected to one another, for example, due to an aforementioned enlargement relative to the recesses 513; 514 on the gravure inking cylinder 512 or on the forme cylinder 503 and only a small spacing from one another, for example, in which case the elevations 524; 524' are still individually discernible at least on a longitudinal section that is not merged. It is also possible for entire areas of merged elevations 524; 524' to be provided, such that, as a result of the larger size and due to a high line density on the forme cylinder 503 and/or on the gravure inking cylinder 512, individual recesses 513, e.g. in the interior of such an area, become merged and are no longer individually resolved and/or discernible. Nevertheless, in the following such elevations 524; 524' on the gravure inking cylinder 512, which result from the transfer of the individual recesses 514 on the forme cylinder 503 to individual, in this case overlapping elevations (e.g., in contrast to the aforementioned rough areas 522) are likewise regarded as corresponding to recesses 514 on the forme cylinder 503, since they result, for example, based on a fixed rule, from the individual engravings 513 on the forme cylinder 503 and/or on the gravure inking cylinder 512 and/or allow at least a partial discernment of the underlying structure at the edge of the recesses 514 on the forme cylinder 503. Thus, even where merging does occur, the individual engravings 514 on the forme cylinder 503 form the basis for the pattern of corresponding elevations 524; 524', which due to the regularities applied to individual engravings 514 are also to be understood in this sense as corresponding to individual recesses 514 on the forme cylinder 503. Moreover, at least a number of actually individually resolved elevations 524, i.e. elevations 524 that correspond precisely to an engraving 513, are preferably also included on the outer cylindrical surface 521 of the relief inking cylinder 519.

Especially in the case of the aforementioned raised areas 522, the dimensions of which are greater than those of individual elevations 524, this second inking unit cylinder 519 is also referred to as a chablon cylinder 519.

Generally, all elevations 524; 524' on the relief inking cylinder 519 that are assigned to recesses 514 on the forme cylinder 503 or to recesses 514 of the same image motif on the forme cylinder 503 can be configured as correlated, corresponding elevations 524; 524', individual or merged as described above, or optionally as only some of the elevations 522; 524; 524' provided on the relief inking cylinder 519, wherein in the latter case, one or more larger raised areas 522 may also be provided.

The elevations 522; 524; 524' are, for example, elevations 522; 524; 524' having a height of between 0.03 and 2.0 mm, for example, in particular a height of between 0.5 and 1.2 mm in relation to the non-printing base. Said non-printing base is provided at the same depth, for example, so that elevations rolling in the same cylindrical shell surface produce elevations of the same height above the base. For the embodiment comprising only larger raised areas 522, the height of said areas above the base may be greater than that of the elevations 524; 524' correlated to individual engravings 514.

Figure 4A:
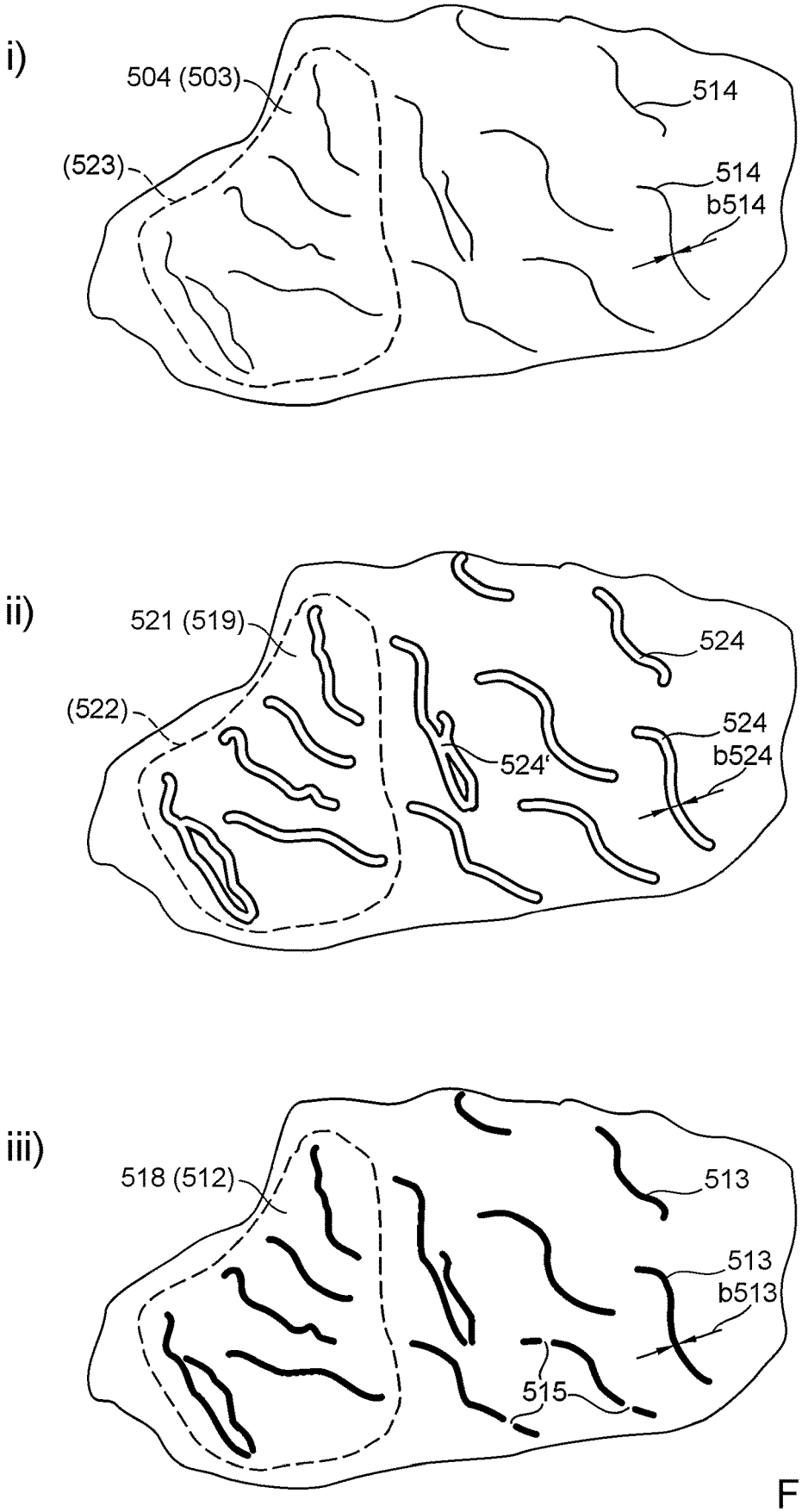
FIG. 4*a* a schematic illustration of i) a pattern of recesses on the forme cylinder, ii) a pattern of corresponding elevations on the inking unit cylinder that has the elevations, and iii) a pattern of corresponding recesses on the inking unit cylinder that has the recesses.

In an embodiment that is to be particularly preferred, the width b524 of elevations 524 on the relief inking cylinder 519 that correspond to engravings 514 on the printing forme 504 is greater than the width b513 of the engravings 513 corresponding thereto on the gravure inking cylinder 512, and the width of these engravings 513 on the gravure inking cylinder 512 is, in turn, greater than the width b514 of the engravings 514 corresponding thereto on the forme cylinder 503 or on the printing forme 504 (see, for example, FIG. 4*a*).

For example, multiple individual elevations 524; 524' on the relief inking cylinder 519 are larger on all sides of the relevant elevations 524; 524', for example by at least 20 μm and/or by no more than 200 μm, advantageously by at least 50 μm and/or by no more than 150 μm, in particular 80 to 120 μm, preferably by 100±5 μm, than the respectively corresponding recesses 513 on the gravure inking cylinder 512 and/or are larger, e.g., by at least 40 μm and/or no more than 400 μm, advantageously by at least 100 μm and/or no more than 300 μm, in particular 160 to 240 μm, preferably by 200±10 μm, than the corresponding recesses 514 on the forme cylinder 503. Thus, for example, for at least some of the recesses 514 on the forme cylinder 503, a line width b524 or width b524 of the corresponding recesses 524; 524' on the relief inking cylinder 519 is larger, e.g., by at least 40 μm and/or no more than 400 μm, advantageously by at least 100 μm and/or no more than 300 μm, in particular 160 to 240 μm, preferably by 200±10 μm, than the corresponding recess 513 on the gravure inking cylinder 512 and/or is larger, e.g., by at least 80 μm and/or no more than 800 μm, advantageously by at least 200 μm and/or no more than 600 μm, in particular 320 to 480 μm, preferably by 400±20 μm, than the corresponding recess 514 on the forme cylinder 503.

In the embodiment comprising corresponding elevations 524; 524', e.g. multiple elevations 524, optionally among other things, which correspond to individual engravings 514 on the forme cylinder 503 and which are greater, e.g. on all sides, by no more than 400 μm, in particular by no more than 300 μm, preferably by no more than 200 μm, than the corresponding recess 514 on the forme cylinder 503, and/or multiple contiguous elevations 524', each resulting from the areal merging of elevations 524 that correspond to a group of recesses 514 on the forme cylinder 503, are provided on the outer cylindrical surface 521 of the relief inking cylinder 519, wherein the contiguous elevations 524' preferably each occupy a contiguous surface area, which results from the overlapping of the relevant corresponding recesses 514 of the forme cylinder 503 that are enlarged on all sides by no more than 400 μm, in particular by no more than 300 μm, preferably by no more than 200 μm, and/or which protrudes on all sides by no more than 400 μm, in particular by no more than 300 μm, preferably no more than 200 μm, beyond the surface area resulting from the shortest envelope curve around the relevant recesses 514. On the relief inking cylinder 519, multiple such individual or merged and contiguous elevations 524; 524', e.g. at least five, are provided per copy $N_i$ to be printed, for example.

In contrast to the aforementioned raised areas 522, in which the raised area 522 extends over the surface area of a plurality of adjacent engravings 514 on the forme cylinder 503, e.g. more than fifty, for example, regardless of the density of recesses 514 on the forme cylinder 503, and at the edge of which area no structure of elevations 524 corresponding to individual recesses 514 on the forme cylinder 503 is discernible, elevations 524 are preferably provided, as elevations 524 that correspond individually to engravings 514 on the printing forme 504, that have, in the region of their smallest diameter, i.e. a shortest distance between opposing margins or edges, for example a maximum width b524 of 1 mm, in particular of no more than 0.8 mm, and/or that have a width b524 that is no more than 0.8 mm, preferably no more than 0.6 mm, greater than that of the corresponding engraving 514 on forme cylinder 503 and/or that match, e.g. individual engravings 514 on the forme cylinder 503 with a greater width b524 by no more than a factor of ten, preferably by no more than of a factor of three, and/or that individually match engravings 514 on the forme cylinder 503 that are spaced from one another, for example, by 1,000 μm or less, preferably by no more than 600 μm, in particular no more than 500 μm, i.e. that ink or can ink elevations 524 that are spaced apart from one another. As merged elevations 524' produced from individual corresponding elevations 524, e.g. overlappings of elevations 524 obtained individually via a regular enlargement from corresponding recesses 514, in contrast to the aforementioned raised areas 522, and/or, e.g. elevations 524' having a maximum diameter of less than 20 mm, in particular less than 10 mm are provided. At least a number, for example, in particular a plurality of such individually resolved and/or merged elevations 524; 524' are formed or provided on the relief inking cylinder 519, in particular over a surface area corresponding to one copy $N_i$.

In the preferred embodiment having the aforementioned corresponding elevations 524; 524', for example, an area of corresponding elevations 524; 524' belonging to the same image motif to be printed in a first ink to be printed or on a first relief inking cylinder 519 may be surrounded on all sides by corresponding elevations 524; 524' belonging to the same image motif of a second ink or of a second relief inking cylinder 524; 524', e.g. of the same printing unit 500, and/or areas of corresponding elevations 524; 524' belonging to the same image motif to be printed in a first ink or on a first relief inking cylinder 519 and areas of corresponding elevations 524; 524' belonging to the same image motif of a second ink to be printed or on a second relief inking cylinder 519 may be interwoven or may penetrate one another when rolled out.

In a preferred embodiment having the aforementioned elevations 524; 524', e.g. more than 50, in particular more than 100, and in special configurations even more than 250 such spaced-apart, i.e. non-contiguous elevations 524; 524' are provided on the relief inking cylinder 519 and/or, e.g. at least 5, advantageously at least 10, in particular more than 25, and in special configurations even more than 50 such spaced-apart, i.e. non-contiguous, elevations 524; 524' are provided on an outer cylindrical surface area of the relief inking cylinder 519 that corresponds to one copy $N_i$.

In an embodiment that is advantageous in the case of a particularly high resolution, the relief inking cylinder 519 comprises on its outer cylindrical surface 521, e.g. elevations 524; 524' that have, in the region of their smallest diameter, a maximum width b524 of 0.6 mm and/or a width b524 that is no more than 0.3 mm greater than the width b514 of the corresponding engraving 514 on the forme cylinder 503, and/or that match individual engravings 514 on the forme cylinder 503 with a width b514 that is greater by no more than a factor of three and/or that match engravings 514 that are spaced from one another, for example, by 0.5 mm or less on the forme cylinder 503.

For example, areas having more than 20 or more than 50 (individually resolved and/or merged) non-contiguous elevations 524; 524' over a surface area of 10 $cm^2$, preferably over a surface area of 1 $cm^2$, and/or having two or more non-contiguous elevations 524; 524' are provided, which are spaced by no more than 1,000 μm, in particular no more than 500 μm, preferably no more than 300 μm from an adjacent elevation 524; 524'. For example, the relief inking cylinder 519 comprises on its outer cylindrical surface 521 a number of areas, corresponding to the number of copies $N_i$ to be printed, which have such a surface density and/or resolution of elevations 524; 524' and which are arranged in rows and columns according to the grid of the copies $N_i$ to be printed.

Areas that have an aforementioned surface density and/or resolution of elevations 524; 524' can have at least five elevations 524; 524' and/or can extend, e.g. over at least 1 $cm^2$, in particular over at least 2 $cm^2$. Said elevations 524; 524' are not required to be evenly distributed within such an area and/or may be part of a larger area that also comprises, e.g., elevations 524; 524' in a lower surface density and/or a greater resolution.

Independently, in general, of the presence of an area having an aforementioned number, surface density, and/or resolution, but preferably in conjunction therewith, the relief inking cylinder 519 can have areas on its outer cylindrical surface 521, the number of areas corresponding in particular to the number of copies, and said areas comprising a total of at least five, for example, preferably at least ten non-contiguous elevations 524; 524' over a surface area of 10 $cm^2$.

The embodiment of the relief inking cylinder or cylinders 519 having individual and/or merged elevations 524; 524' that correspond in the aforementioned manner, for example, allows color resolutions and/or image effects to be achieved that otherwise cannot be realized in gravure or intaglio printing. This applies not only, but especially in conjunction with an aforementioned gravure inking cylinder 512.

The engravings 513 on the gravure inking cylinder 512 are provided directly on the outer cylindrical surface 518 of the gravure inking cylinder 512, for example, which is comprised at least by the cylinder shell on the outer circumference of the gravure inking cylinder 512, or are provided on the outer circumference of an ink transfer forme embodied as a printing forme, which may be in the form of a circumferentially closed ink transfer forme sheath, e.g. what is known as a sleeve, or in the form of a finite gravure printing forme, e.g. with leading and trailing ink transfer forme ends. In an advantageous embodiment, the engravings 513 are provided in a ceramic or metallic outer layer of the inking unit cylinder 512 or the ink transfer forme sheath.

In an advantageous embodiment, the raised areas 522 or elevations 524; 524' of the second inking unit cylinder 519 can likewise be provided on the surface of an ink transfer forme, which is or can be detachably arranged in the form of a circumferentially closed ink transfer forme sheath, e.g. what is known as a sleeve, on a cylinder body that is or can be rotatably mounted in the inking unit 508.

On at least the side of the aforementioned downstream application point in the operating direction of rotation D of the inking unit cylinder 512 comprising the recesses 513, the inking device 511 comprises a retaining means 526, e.g. a doctor blade or an ink blade, by means of which, as viewed in the operating direction of rotation D, downstream of the ink application, and particularly upstream of a nip point 554 with a subsequent inking unit cylinder 519, printing ink 517 applied previously to the outer cylindrical surface 518 can be removed.

In particular, the inking device 511 has such a retaining means 526 on at least the downstream side of the ink supply chamber 516 in the operating direction of rotation D of the gravure inking cylinder 512, and by means of said retaining means, on the output side of the ink supply chamber 516 as viewed in the operating direction of rotation D, i.e. in the region of the downstream end of the ink supply chamber 516, printing ink 517 that has been carried along previously by contact with the outer cylindrical surface 518 can be removed. In this embodiment of the ink application process, the ink supply chamber 516 is delimited on its downstream side in the circumferential direction by the retaining means 526.

The inking device 511 is preferably configured without inking zones, i.e. for example without individually adjustable inking zones, and/or with a retaining means 526 that is continuous in the axial direction across the printing width and/or without individually adjustable ink blade sections.

The inking device 511 preferably also comprises a sensor device, by means of which a measure of the volume of ink present in the ink supply chamber 516 and/or a fill level, but at least information regarding the reaching of a critical fill level, e.g. a lower and/or an upper limit value of the fill level, can be derived.

In a first embodiment that is advantageous, e.g. in terms of a particularly low ink infeed, the inking device 511 comprises, on at least the downstream side of the application point or of the ink supply chamber 516 in the operating direction of rotation D of the inking cylinder 512, a retaining means 526 in the form of a wiping means, in particular a doctor blade, the contact force of which is preferably variable or adjustable and which is in physical contact with the preferably hard and unyielding outer cylindrical surface 518 of the gravure inking cylinder 512, in particular at least in the working or operating position, which retaining means can be used to remove, substantially completely, printing ink 517 that has been applied to non-engraved regions. In this way, an infeed of printing ink 517 at points where no printing ink 517 is required on the forme cylinder 503 can be reduced quite substantially from the outset. A complete removal of the printing ink 517 is also understood to mean that traces of printing ink 517 will remain on non-engraved regions of the outer cylindrical surface despite doctoring with physical contact. In contrast to ink blades, with which the ink layer thickness desired for operation can be adjusted, e.g. zonally, by adjusting the size of the gap between cylinder shell and ink blade, and which can be moved up to the outer cylindrical surface, e.g. to avoid an outflow of printing ink in the idle state, the retaining means 526 that is in physical contact with the preferably hard and unyielding outer cylindrical surface 518 of the gravure inking cylinder 512 is understood as one that during operation is set against the outer cylindrical surface 518 for the purpose of doctoring the printing ink 517. A doctor blade suitable for this purpose must have greater abrasion resistance and/or hardness at the end of the doctor blade that is in physical contact in the working position than would be required for an adjustable ink blade that is spaced at a distance during operation. At the same time, it must have a certain elasticity and/or resilience so that it will rest flexibly and/or across the entire width against the outer cylindrical surface 518. The retaining means 526 embodied as a doctor blade is configured, at least in a section adjoining the doctor blade edge, with a thickness of 0.7 to 1.3 mm, for example, in particular of 0.9 to 1.1 mm. In addition to or independently of this, the embodiment that involves physical contact during operation requires, e.g., a positioning drive 551, which moves the doctor blade not only up to the position of initial contact, but beyond that to the point of at least slight elastic deformation caused by the contact pressure against the outer cylindrical surface 518.

The retaining means 526, in particular in the form of a wiping means, e.g. a doctor blade, is advantageously configured as "positive" or is arranged correspondingly "positively" in the inking device 511, i.e. it is or can be deployed at an inclination relative to the tangent, so that the tangent at the point of contact forms an acute angle with the retaining means 526, e.g. wiping means, in particular the doctor blade, on the side of the ink supply chamber 516. This angle prevails, e.g. at least in the region of the operative end, i.e. in an end section of the retaining means 526, e.g. at least 3 mm in length, which cooperates in contact with the outer cylindrical surface 518 or without contact with the same.

In an embodiment of the pattern of recesses 513 on the gravure inking cylinder 512 that is advantageous particularly in conjunction with the embodiment of the retaining means 526 as a doctor blade that is in physical contact during operation, recesses 513, in particular line-like recesses, on the gravure inking cylinder 512 that correspond to recesses 514 on the forme cylinder 503 are at least not all configured to be uninterrupted; instead, particularly in the case of recesses 513 on the gravure inking cylinder 512 of greater length, e.g. for recesses 513 measuring at least 500 μm or even at least 1 mm in length, at least some have at least one supporting point 515, in particular one supporting ridge 515, which interrupts the recess 513 on the second inking unit cylinder 512 that corresponds to the continuous recess 514 on the forme cylinder 503 and/or which lies within the envelope of a recess 514 that corresponds in shape to a continuous recess 514 on the forme cylinder 503, and whose upper surface lies at the level of the undisrupted, i.e. non-engraved, outer cylindrical surface 518 of the gravure inking cylinder 512, for the purpose of supporting the doctor blade (indicated, e.g., in FIG. 4*a*, iii), by way of example, in two engravings 513 in the lower portion of the diagram). A supporting ridge 515 of this type, the upper surface of which lies at the uninterrupted level, preferably connects two wheels that lie on opposite sides of the relevant recess 513 to one another. These supporting points 515 or supporting ridges 515 prevent the doctor blade edge from dipping, e.g. even very slightly, into elongated recesses 513, which can lead to irregularities in the doctor blade edge and/or to erosions at the edges of recesses 513 if such dipping is repeated a large number of times.

Preferably, however, such supporting points 515 or supporting ridges 515 are not placed individually in individual recesses 513, and are instead accounted for or provided during the derivation of recesses 513 to be provided on the gravure inking cylinder 512 from image-forming recesses 514 on the forme cylinder 503, particularly during the transformation of image-forming recesses 514 present or to be provided on the forme cylinder 503 into specifications for corresponding recesses 513 to be provided on the gravure inking cylinder 512, as will be described in greater detail below, for example.

Such supporting points 515 or supporting ridges 515 can generally be provided, by means of appropriate software, for example, "randomly", i.e. in a random, non-regular arrangement, which involves advantages in terms of the avoidance of visible structures. In a solution that is advantageous in terms of the reliability of secure support, however, supporting points 515 or supporting ridges 515 are superimposed on the pattern of recesses 513 on the gravure inking cylinder 512 in a regular structure 525 (see, e.g., FIG. 4*b*, ii)). Said structure is preferably superimposed over the entire area of recesses 513 of the same image motif to be inked on the forme cylinder 503, e.g. over all lines or the lines of an ink segment of the image to be depicted, for example a portrait, a building, or an illustration of fauna or flora. As a result of said superposition, in places where the intended structure 525 and a recess 513 on the gravure inking cylinder 512 overlap, an elevation is or will be provided, the height of which is at the level of the uninterrupted outer cylindrical surface 518. In other words, the structure 525 is only discernible in the region of the recesses 513, at the supporting points 515 or supporting ridges 515 extending there according to the pattern of recesses 513, and continues correspondingly, e.g. in adjacent recesses 513.

Such a regular structure 525 of supporting ridges 515 can generally be configured in a variety of ways. For example, supporting ridges 515 can be provided along rectilinear and parallel lines of an open structure 525 configured as a line structure 525 (see, e.g., FIG. 4*b, i*) and ii). Alternatively, supporting ridges 515 may be provided on walls of closed, circular or polygonal structures 525, such as honeycomb structures 525, for example (see, e.g., FIG. 4*b*, iii)), or along structures 525 that run in opposite directions (see, e.g., FIG. 4*b*, iv)) or in the same direction, such as wave structures 525 (see, e.g., FIG. 4*b, v*)), or along structures 525 otherwise provided in open or a closed form. In a particularly advantageous embodiment, the structure is superimposed, e.g. as a line structure 525 of rectilinear lines, onto the pattern of recesses 513, in which case the lines run rectilinearly and parallel to one another and are spaced apart from one another by 100 to 700 μm, for example, advantageously by 200 to 600 μm, and/or run at an incline of 10° to 40° (ten degrees to forty degrees), for example, advantageously 15° to 35° (fifteen degrees to thirty-five degrees), in particular 20° to 30° (twenty to thirty degrees), in relation to a line that runs parallel to the axis of rotation of the gravure inking cylinder 512 on the outer cylindrical surface 518, or in relation to the doctor blade edge 566, and/or have a ridge width at the level of their surface of 10 to 50 μm, for example, in particular of 15 to 45 μm, preferably of 20 to 40 μm. In particular, in a first, e.g., rougher configuration, the lines are spaced apart by, for example, 300 to 700 μm, advantageously 400 to 600 μm or, in a second, e.g., finer configuration, they are spaced apart by, for example, 100 to 500 μm, advantageously 200 to 400 μm, in particular 300±30 μm, or, for example, in a first, e.g., steeper configuration, run at an incline of 20° to 40° (twenty to forty degrees), advantageously 25° to 35° (twenty-five degrees to thirty-five degrees), in particular 30°±2° (thirty degrees plus minus two degrees), or in a second, e.g., flatter configuration, 10° to 35° (ten degrees to thirty-five degrees), advantageously 15° to 25° (fifteen degrees to twenty-five degrees), in particular 20°±2° (twenty degrees plus minus two degrees) in relation to a line that runs parallel to the axis of rotation of the gravure inking cylinder 512 on the outer cylindrical surface 518, or in relation to the doctor blade edge 566, and/or, in a first, wider configuration, e.g., have a ridge width at the level of their surface of 30 to 50 μm, in particular 35 to 45 μm, preferably of 40°±2° μm, or, in a second, narrower configuration, have a ridge width of 10 to 40 μm, in particular 15 to 30 μm, preferably 20±2 μm. The finer and/or narrower configuration, even though it may be more complex, can reduce the risk of a line formation in, e.g., in image regions having a high line density, if necessary, and, for example, the wear behavior of the doctor blade may be influenced on the one hand, and the filling of the recesses may be influenced on the other hand, by the angle of inclination.

The above-described structures shall, in particular, be understood to mean the structures, developed in the plane, of the patterns provided on the cylinder circumferential surface, e.g., an inclined line structure of a pattern extending spirally around the cylinder circumference. In particular, the supporting ridges 515 continue from recesses 513 that follow one another in the direction of the progression of the structure, and that intersect the relevant structural form, along the corresponding structural form, wherein the surface regions that are located therebetween and are undisrupted, i.e., do not contain any recesses 513, remain without supporting ridges 515, even in the region of the imaginary continuation of the structure.

Figure 4B:
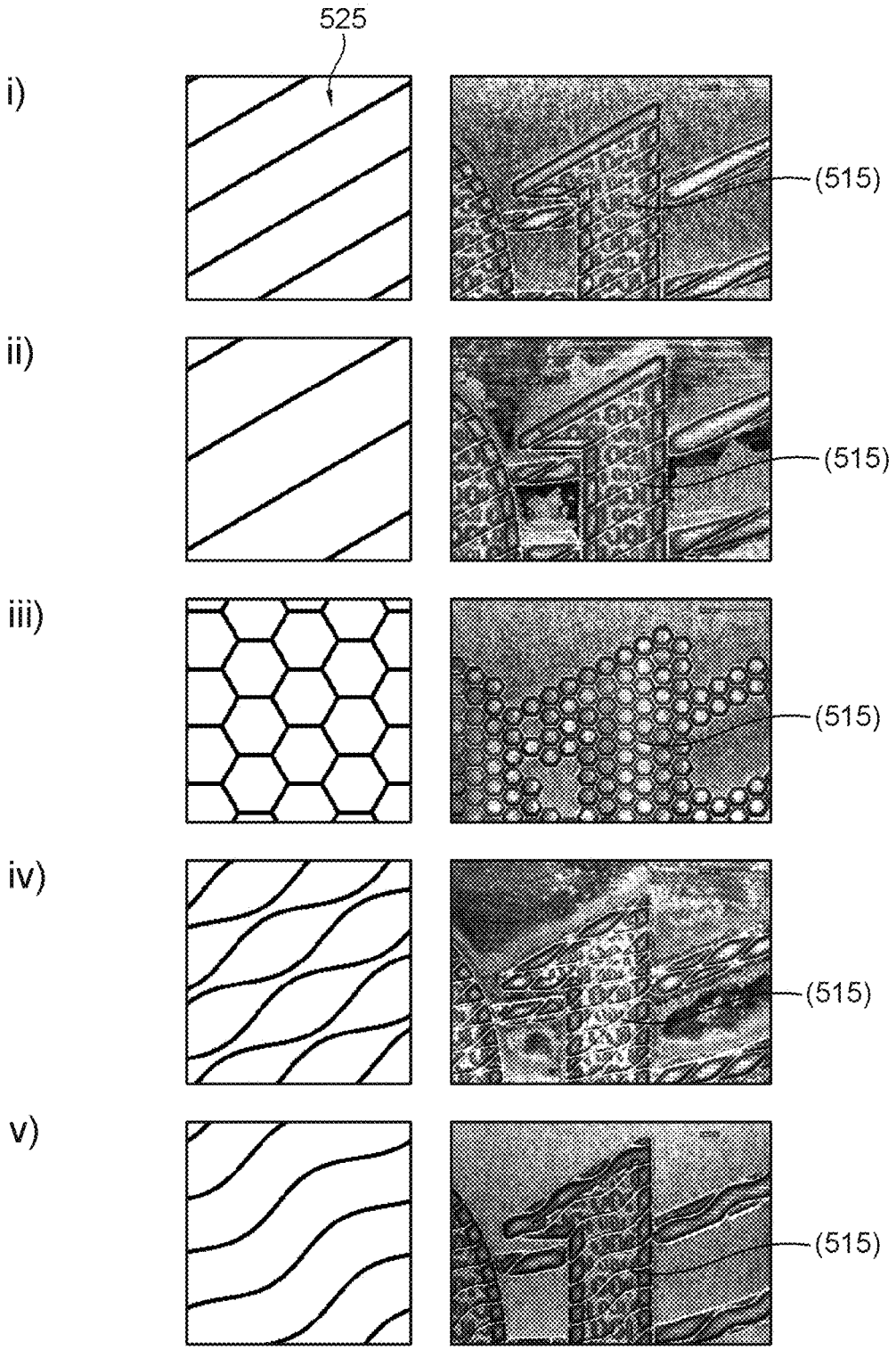
FIG. 4*b* a schematic detail illustration of advantageous embodiments of the formation of recesses on the inking unit cylinder.

In FIG. 4*b*, e.g. for each of the structural forms mentioned an example of the underlying structure 525 is provided, along with an illustration of an image section showing a corresponding structure 525. The reference number 515 for the ridges has been placed between parentheses there because they are only indirectly visible.

In another embodiment, which is advantageous in terms of wear, for example, on at least the downstream side of the application point or the ink supply chamber 516 in the operating direction of rotation D of the gravure inking cylinder 512, the inking device 511 can comprise a retaining means 526 configured as an ink blade, for example, preferably an adjustable ink blade, by means of which in the working or operating position, a small, preferably adjustable distance of at least 2 μm, for example, in particular at least 5 μm, and/or of less than 100 μm, for example, advantageously less than 50 μm, in particular less than 20 μm, from the outer cylindrical surface 518 of the gravure inking cylinder 512 can be produced or is produced during operation. In this way, the printing ink 517 applied to non-engraved regions is or can be limited to a thin layer thickness of at least 2 μm, for example, in particular at least 5 μm, and/or less than 100 μm, advantageously less than 50 μm, in particular less than 20 μm. In this embodiment, an arrangement of the above-described supporting ridges could be dispensed with.

Particularly in conjunction with at least a substantial removal of the printing ink 517, i.e. a complete removal or a removal except for a thin layer, from the non-engraved outer cylindrical surface regions of the gravure inking cylinder 512, a significant ink infeed is achieved selectively at desired locations; for that reason, the inking unit cylinder 512 or gravure inking cylinder 512 that is furnished with the engravings 513 or recesses 513 is also referred to as a "selective cylinder" 512.

The relief inking cylinder 519 has, on its circumference, a preferably elastic and/or at least slightly compressible material layer, for example, the outer surface of which forms the outer cylindrical surface 521 and which comprises the raised areas 522 or elevations 524; 524' and the recesses therebetween.

The gravure inking cylinder 512 to be inked by the inking device 511 and the relief inking cylinder 519 downstream, optionally with one or more inking unit rollers or cylinders arranged in series therebetween, make up an inking unit 529 here, hereinafter also called an inking train 529, by means of which printing ink 517 of a certain color can be fed into the printing unit 500 and is or can be conveyed in the direction of the forme cylinder 503.

Said inking train 529 can generally be arranged, in the region of its downstream end, with the outer cylindrical surface 521 of the chablon cylinder 519, for example, cooperating directly with the forme cylinder 503 or with the printing forme 504 thereof, in the printing unit 500. In an embodiment that is advantageous in terms of multicolor printing, multiple such inking trains 529, e.g. at least two, can also be arranged around the forme cylinder 503. It is also possible for the forme cylinder 503 to be assigned one or more inking trains 529 configured as having a gravure inking cylinder 512, as described above, and one or more inking units 532, e.g. inking trains 532, configured differently, e.g. configured conventionally without a gravure inking cylinder, and having an ink fountain comprising an ink blade, for example, and an ink fountain roller with a smooth surface.

When multiple inking trains 532 are provided, each of these inks up one "color segment" of the print image, for example, i.e. one print image segment assigned to this color to be applied. The pattern of recesses 513 and/or elevations 524; 524' or raised areas 522 on the relevant inking unit cylinders 512; 519 of two inking trains 529 are therefore different from one another, at least to a large extent. In particular, the relevant inking unit cylinders 512; 519 have different patterns of recesses in the respective region of the outer cylindrical surface 518; 521 that corresponds to the same image motif to be printed at the printing nip 502.

In a preferred embodiment, particularly with regard to multicolor printing, the inking train 529 is arranged in the region of its downstream end, e.g. in the region of the relief inking cylinder 519, cooperating with another inking unit cylinder 531, e.g. acting as a transfer cylinder 531. Said cylinder is in turn arranged cooperating with the forme cylinder 503 in the printing unit 500 and preferably has an elastic and/or compressible outer cylindrical surface.

Figure 2A:
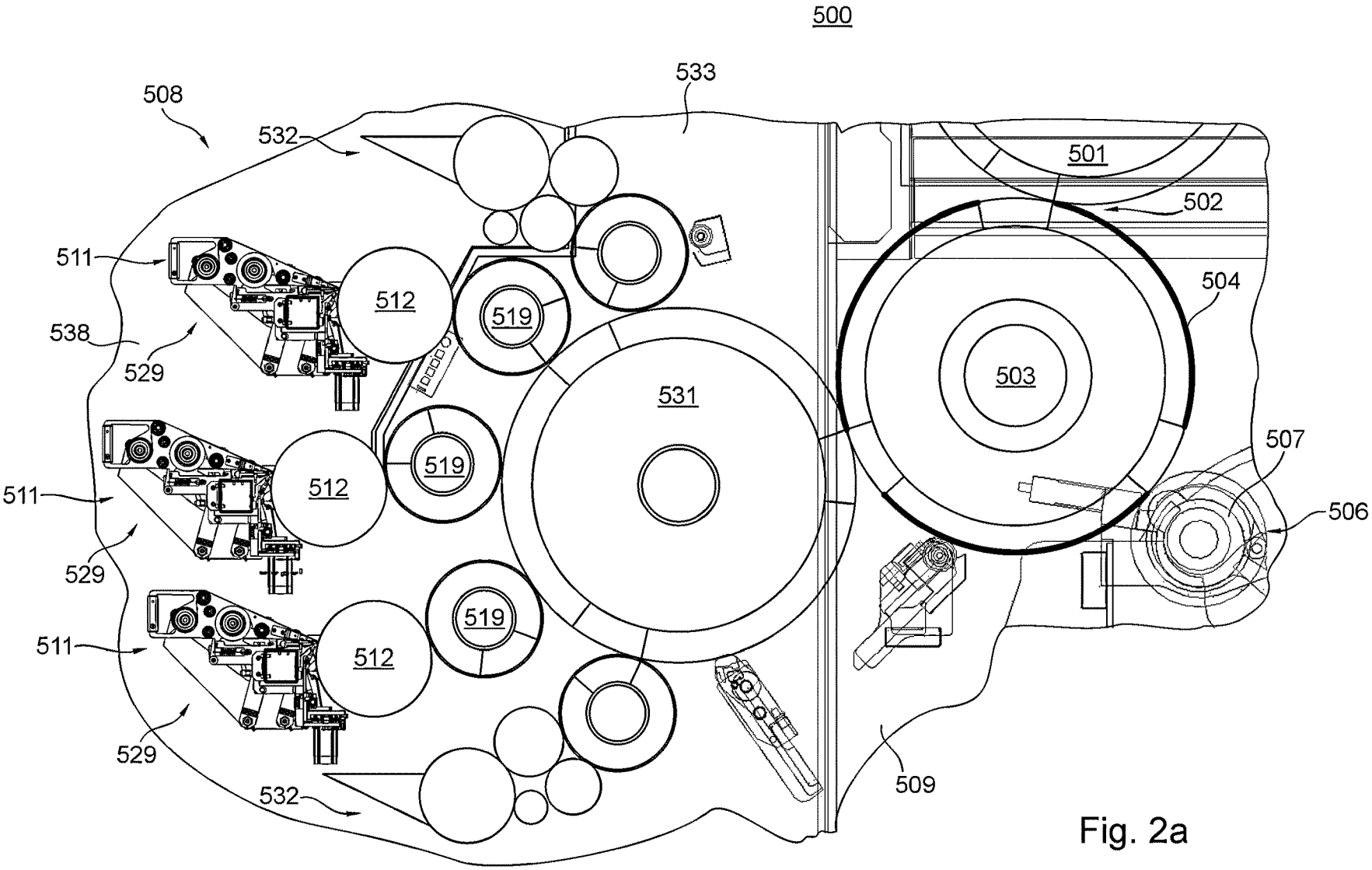
FIG. 2*a* an enlarged illustration of the printing unit of FIG. 1*a;*
Figure 2B:
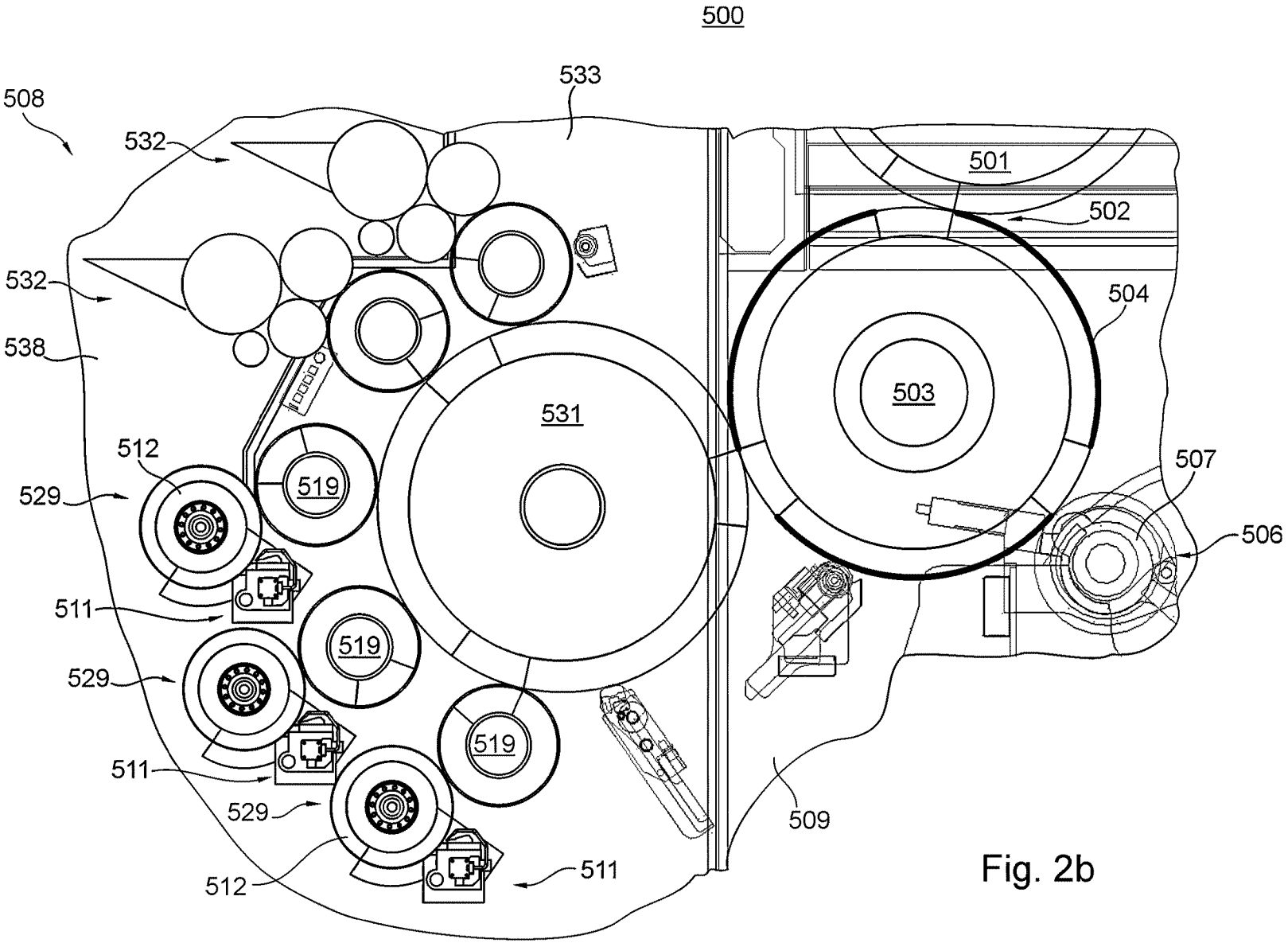
FIG. 2*b* an enlarged illustration of the printing unit of FIG. 1*b;*

In a particularly preferred embodiment of the printing unit 500 as a multicolor printing unit 500, in particular configured for simultaneous multicolor printing at the printing nip 502, the additional inking unit cylinder 531 is embodied or acting as an ink collecting cylinder 531. In that case multiple inking trains 529, e.g. at least two, configured as described above as having a gravure inking cylinder 512, or a combination of one or more inking trains 529 configured as described above as having a gravure inking cylinder 512 and one or more inking trains 532 that are configured differently, e.g. conventionally, without a gravure inking cylinder, for example with an ink fountain comprising an ink blade and an ink fountain roller with a smooth surface, can be arranged on the circumference of the ink collecting cylinder 531. For example, a total of five inking trains 529; 532 may be provided, of which, for example, three, e.g. lower, inking trains 529 are configured as inking trains 529 that feed in printing ink 517 selectively (i.e., selective inking trains 529) while the other two, e.g. upper, inking trains 532 are conventionally configured (see, e.g. FIG. 2*b*). However, it is also generally possible for another heterogeneous breakdown and/or positioning of selective and conventional inking trains 529; 532 to be provided, e.g. one lower and one upper inking train 532 of five conventionally configured inking trains 529; 532 with three selective inking trains 529 therebetween, or for a homogeneous embodiment with exclusively selective inking trains 529 to be provided.

Generally, the inking device 511 can be arranged as desired so as to cooperate with the outer cylindrical surface 518 on the open circumference, i.e. on the circumference that is not covered by the nip point 554 with the relief inking cylinder 519 or by any other components.

In a first embodiment, however (see, inter alia, FIGS. 1*a*, 2*a* and 3*a*), the inking device 511 can be arranged on the side of the gravure inking cylinder 512 that faces away from the relief inking cylinder 519. In that case, the aforementioned line of contact or line of the shortest distance is on the side that faces away from the relief inking cylinder 519, for example. Thus a line of contact that, if the retaining means 526 is embodied as a wiping means, in particular a doctor blade, is formed between said means and the outer cylindrical surface 518 of the gravure inking cylinder 512, or if the retaining means 526 is embodied as an ink blade, the line of the shortest distance on the circumference of the gravure inking cylinder 512, lies in this first embodiment of the positioning of the inking device 511 on a circumferential section of the gravure inking cylinder 512 that is on the side facing the relief inking cylinder 519, in particular upstream of the line of intersection with the aforementioned vertical plane, as viewed in the operating direction of rotation D. A line of contact is also understood, of course, as a point of physical contact that, as viewed in the circumferential direction, has an actual width not equal to zero, e.g. a width of up to 2 mm. In the case of physical contact, this may be caused by a "grinding in" of the doctor blade edge through contact with the outer cylindrical surface 518 and/or may be desirable to create a better seal.

In an alternative second embodiment, which is especially advantageous particularly with respect to ink supply and ink metering (see, inter alia, FIGS. 1*b*, 2*b* and 3*b*), the inking device 511 is arranged on the side of the gravure inking cylinder 512 that faces the relief inking cylinder 519. A side of the gravure inking cylinder 512 is understood as a hemisphere that lies on one side of a vertical plane running through the axis of rotation R512 of the gravure inking cylinder 512.

In that case, both for the first and for the alternative embodiment, an arrangement of the gravure inking cylinder(s) and associated relief inking cylinder(s) 512; 519 in the printing unit 500 is provided, such that, in the print-on position, the plane connecting the rotational axes R512 of the gravure inking cylinder and the associated relief inking cylinder 512; 519 of all, some, or at least one gravure inking cylinder 512, e.g. a third of five, comprised by the printing unit 500, forms an angle of no more than 60°, preferably an angle of no more than 45°, with the horizontal. An arrangement of this type represents an arrangement of the main components of the inking unit aligned predominantly in the horizontal direction, namely from the infeed of ink, through the selective transfer and optionally the collection of ink, to the inking of the forme cylinder 503.

Where the two aforementioned embodiments functionally involve the same components or component groups, no differentiation is made in the reference symbols used for this purpose.

The inking unit cylinders 512; 519; 531 and the inking device 511 may be provided, together with the printing unit cylinders 501; 503, in a common frame, or may be arranged in a separate frame 533; 538, e.g. frame section 533; 538, which is different from the frame supporting the printing unit cylinders 501; 503, for example. Generally independently of the specific position and/or specific configuration of the inking device 511, but advantageously in conjunction with one of the aforementioned positions and/or embodiments, the inking unit frame 533, 538 is configured as separable. Said frame comprises a frame 538, e.g. frame section 538, that supports, e.g. the at least and the inking device 511 and the gravure inking cylinder 512 and has frame walls provided on both sides, which can be separated from a frame part that supports the relief inking cylinder(s) 519 and optionally the transfer cylinders 531 and can be moved away or backed out radially, in particular horizontally, in order to form therebetween, for example in the open state, an operating and/or maintenance space for operating technicians. Said frame part may be a frame part that also supports the printing unit cylinders 501; 503, but is preferably embodied as a frame section 533 assigned solely to the inking unit 508, which can in turn be moved away from a preferably spatially fixed frame section supporting the printing unit cylinders 501; 503, radially of the printing unit part 509, in particular horizontally, in order to form therebetween, for example in the open state, an operating and/or maintenance space for operating technicians.

Generally independently of the specific position and/or specific configuration of the inking device 511, but advantageously in conjunction with one of the aforementioned positions and/or embodiments, the inking device 511, but at least the retaining means 526, e.g. wiping means or doctor blade, or the ink blade, and if applicable the boundaries of the ink supply chamber 516 on the sides of the inking device 511, is adjustable with respect to its radial position relative to the gravure inking cylinder 512, for example it can be moved further or closer to the outer cylindrical surface 518 and less or further away from the outer cylindrical surface 518 (as indicated, e.g., schematically by double arrow 534). Positioning is implemented by means of a positioning drive 551, e.g. via a transmission 527 comprised by the positioning drive 551, and/or is preferably implemented by a remotely actuatable drive means 536 comprised by the positioning drive 551. The positioning drive 551, in particular for the embodiment of the retaining means 526 as a doctor blade that is in contact during operation, is preferably configured such that if the doctor blade becomes shortened due to wear, the doctor blade will be repositioned toward or against the outer cylindrical surface 518. This can generally be accomplished by means of a control loop having a sensor that registers the shortening and a drive motor 536 as the drive means, or by means of a drive motor 536 as the drive means 536, which is controlled with respect to the applied torque. In a particularly advantageous embodiment, the drive means 536 is configured as a force-based drive means 536, preferably in the form of a pressurized medium-actuated actuator 536, e.g. working cylinder 536, in particular pneumatic cylinder 536. Particularly if the retaining means 526 is configured as a doctor blade, this enables a level of contact force to be ensured and/or to be varied selectively by choosing the pressure level. If the retaining means 526 is configured as an ink blade, the distance of which is adjustable, for example, such a force-based drive means 536 can be positioned against a preferably adjustable stop means, for example. This positioning movement preferably takes place in a region at least close to the cylinder, i.e. in at least the last 3 mm before reaching the outer cylindrical surface 518, for example, linearly or at least approximately linearly. The conditions at the outer cylindrical surface 518 are thus maintained, e.g. even with repositioning or with changing lengths of the retaining means. In the case of a pivoting movement about a pivot axis, preferably with a radius of curvature that corresponds to at least twice the diameter of the gravure inking cylinder. Particularly advantageous is a movement, or a guidance that forces said movement, for which the angle of inclination of the retaining means 526 or of the entire moving assembly, e.g. in relation to horizontal or to the tangent of the gravure inking cylinder 512 at the point of contact, is maintained within the positioning range in the case of repositioning induced by wear and/or with activation and deactivation of the retaining means. Said movement preferably extends linearly in the doctor blade plane, i.e. in the direction of the extension thereof running from the mount to the first physical contact with the gravure inking cylinder 512. Said movement can be defined via a guide, which defines the movement path and which is included in the drive train between drive means 536 and the component to be moved, or which, parallel to the drive train acting on the component, forces the component that is to be moved onto the movement path.

The guide that maintains the angle of inclination of the retaining means 526 or of the parts that delimit the ink supply chamber 516 on the sides of the inking device 511, e.g. with respect to the horizontal, may be provided, in particular, as a straight linear guide, for example, or as a parallelogram guide. For this purpose, the inking device 511 or at least the retaining means 526 and the parts that form the ink supply chamber 516 on the sides of the inking device 511 are mounted, accordingly movably, for example directly or indirectly on a side part 537, e.g. side frame part 537, in particular side panels 537, which side part is in turn mounted, immovably fixed, on a frame 538 of the inking unit 508 or preferably on holding means 539 that are fixed with respect to the axis of rotation R512 of the gravure inking cylinder 512, e.g. end-face side parts 539 of a subframe that is moved along with the gravure inking cylinder 512. For the preferred case in which the gravure inking cylinder 512 is mounted movably in the frame 538 of the inking unit 508, e.g. for alignment purposes or for throwing-on and throwing-off in the radial direction, mounting the inking device 511 or the frame part 537 that supports the inking device 511 in a manner fixed to the cylinder, i.e. coupled to the gravure inking cylinder 512, ensures a constant relative position of retaining means 526 and outer cylindrical surface 518, even when the gravure inking cylinder 512 changes position.

The end-face side parts 539 can be arranged fixed, for example, to an outer, non-rotating but, e.g. itself eccentrically mounted bearing ring of a radial bearing, which receives an end-face cylinder journal or an end-face ends of a shaft supporting the inking unit cylinder 512. In the following, where not explicitly distinguished, such a shaft end is also referred to as journal or cylinder journal of the gravure inking cylinder 512. Said bearing ring, embodied as eccentric, for example, or an outer ring that accommodates said bearing ring eccentrically, is mounted, e.g. in a frame bore and is configured, for example, as an eccentric ring, in particular as an eccentric bushing.

To reinforce the subframe, the two side parts 539 can be reinforced, e.g. in an end region situated remotely from the axis of rotation R512 of the gravure inking cylinder 512, by a cross member, in particular a crossbar.

The positioning mechanism and its drive can generally be configured such that, in addition to adjusting the position and/or the contact force or the distance of the retaining means 526, it is also possible to back the inking device 511 away over a long positioning path, e.g. at least 50 mm, in particular 100 mm, which is necessary for maintenance or makeready purposes, for example. In an advantageous embodiment, however, the inking device 511 is mounted, e.g. on frame part 537, such that it can be moved away from the gravure inking cylinder 512, for example such that it is pivotable about an axis 541 provided on the frame part 537. Movement toward and away from the cylinder can be implemented manually or by a remotely actuatable drive means.

Generally independently of the specific position and/or specific configuration of the inking device 511, but advantageously in conjunction with one of the aforementioned positions and/or embodiments, the inking device 511, but at least the retaining means 526, e.g. in the form of a wiping means or doctor blade or as an ink blade, and optionally the boundaries of the ink supply chamber 516 on the sides of the inking device 511, is mounted such that it is movable, in particular can oscillate, in its axial position relative to the gravure inking cylinder 512, for example such that it is movable back and forth between a right end position and a left end position. This movement corresponds, e.g. in FIG. 3*a* and FIG. 3*b*, to a movement into and out of the plane of the sheet and is therefore indicated only by a slightly inclined double arrow 542 and by the symbols representing an arrow end and an arrow tip. This oscillating movement is preferably carried out over a total traversing distance of at least 2 mm, e.g. a distance between 3 and 8 mm, preferably between 4 and 6 mm. The mounting of the inking device 511 or at least of the retaining means 526, e.g. in the form of a wiping means or a doctor blade or an ink blade, and optionally of the boundaries of the ink supply chamber 516 on the sides of the inking device 511, is configured to enable an axial oscillation over a traversing distance of at least 2 mm, e.g. a distance of between 3 and 8 mm, preferably between 4 and 6 mm. The axial movement is implemented via an axial drive 552, for example oscillating drive 552, e.g. via a transmission 528 comprised by the oscillating drive 552 and/or preferably by a remotely actuatable drive means 543, in particular an electric motor 543, which is comprised by the oscillating drive 552. For this purpose, the inking device 511 or at least the retaining means 526, in particular the doctor blade, and the parts that form the ink supply chamber 516 on the sides of the inking device 511, are mounted such that they are correspondingly axially movable on the frame part 537, for example, or on the frame, frame part, or frame section 538 that supports the gravure inking cylinder 512. This mounting to enable the axial relative movement may be provided, as described above, directly or indirectly on the frame 538 of the inking unit 508 or preferably on a holding means 539 that is fixed to the cylinder. The frequency for axial oscillation is between 0.05 and 1.00 Hz, for example, preferably within the range of 0.1 to 0.3 Hz.

Generally independently of the specific position and/or specific configuration of the inking device 511, but advantageously in conjunction with one of the aforementioned positions and/or embodiments, a device 544 for axially equalizing the ink level in the ink supply chamber 516, e.g. an ink distribution device 544, in particular an ink stirring device 544, is provided. Said device comprises at least one ink distributor 546, for example, acting as a distributor finger 546 or, in particular, an ink stirrer 546, which protrudes with a leading end 553, at least in the working position, into the ink supply chamber 516, in particular far enough that one end 553 of it is or can be immersed into the fill level located operationally upstream of the retaining means 526 or the doctor blade. In place of the immersed end 553 or preferably additionally thereto, the ink distributor 546 of the ink distribution device 544 can comprise an ink outlet, which is or can be moved axially back and forth on the ink distributor 546 in the ink supply chamber 516, thereby distributing the printing ink 517 to be fed in. During operation, the, in particular viscous, printing ink 517, which is held in reserve in the ink supply chamber 516, forms a so-called ink roll, which forms directly upstream from the retaining means 526 as a result of contact with the outer cylindrical surface 518 as it moves past.

The at least one ink distributor 546 is mounted, axially movably for example, directly or indirectly on the frame 533; 538 that supports the inking device 511, or preferably on a side part 537 of the inking device 511, or directly on an optionally provided cross member 547, e.g. crossbar 547. For example, it is arranged on a slide 548, which is mounted such that it is axially movable in or on a guide 549, in particular a linear guide 549, and is movable back and forth by a drive means, e.g. an electric motor. For instance, in an advantageous first embodiment, it can be moved back and forth by a drive means configured as an electric motor, via a transmission that converts rotation into linear movement, for example. In a second advantageous embodiment, the movement back and forth is carried out by a drive means configured as a pressurized medium-actuated piston-cylinder system. For example, a piston connected to the slide 548 carrying the ink distributor 546 is moved back and forth in an axially extending pressurized medium chamber, e.g. cylinder. In a preferred embodiment, the pressurized medium chamber extends in a crossbar, in particular in the aforementioned crossbar 547 carrying the doctor blade mount or the slide 548 with the doctor blade mount. The two chambers at the two ends of the piston can be supplied with pressurized fluid, in particular pressurized compressed air, through two separate pressurized fluid lines, or through such a pressurized fluid line via a controlled switching valve.

Advantageously, the ink distributor 546 is moved back and forth at a frequency of at least 0.3 Hz, preferably at least 0.5 Hz.

Generally independently of the specific position and/or specific configuration of the inking device 511, but advantageously in conjunction with one of the aforementioned positions and/or embodiments, the gravure inking cylinder 512 is mounted in the inking unit 508 or in the frame 533; 538 thereof such that it is removable operationally, i.e. for example for replacement or for maintenance and/or makeready purposes, and/or without dismantling additional inking unit components, for example. In one embodiment, this may be a removal in the axial direction of the inking unit cylinder 512, or in another embodiment, it may be a removal in the radial direction.

Generally independently of the specific position and/or specific configuration of the inking device 511, but advantageously in conjunction with one of the aforementioned positions and/or embodiments, the gravure inking cylinder 512 is configured as temperature-controllable, in particular such that temperature control fluid can flow through it.

Generally independently of the specific position and/or specific configuration of the inking device 511, but advantageously in conjunction with one of the aforementioned positions and/or embodiments, the temperature of the printing ink 517 to be supplied to the ink supply chamber 516 can be controlled in the line path upstream of an outlet into the ink supply chamber 516. For this purpose, a temperature control device, in particular a heating device, is provided in the ink supply line path, for example.

Generally independently of the specific position and/or specific configuration of the inking device 511, but advantageously in conjunction with one of the aforementioned positions and/or embodiments, in a preferred embodiment the gravure inking cylinder 512 can be rotationally driven by its own drive means, e.g. drive motor, which is mechanically independent of the drive of the other inking unit cylinders 519; 531 and/or printing unit cylinders 501; 503.

Although the disclosure herein has been described in language specific to examples of structural features and/or methodological acts, it is to be understood that the subject matter defined in the appended claims is not necessarily limited to the specific features or acts described in the examples. Rather, the specific features and acts are disclosed merely as example forms of implementing the claims.

The invention claimed is:

1. A gravure printing unit for printing onto a substrate according to a gravure printing method, the gravure printing unit comprising:

a forme cylinder which includes, on a circumference of the forme cylinder, a pattern of recesses for forming an image, and an inking unit for inking the pattern of recesses on the circumference of the forme cylinder, the inking unit comprising a first inking unit cylinder which includes, on an outer cylindrical surface of the first inking unit cylinder, line-like recesses that correspond to line-like recesses of the pattern of recesses on the circumference of the forme cylinder, the inking unit further including an inking device by means of which the first inking unit cylinder can be inked at an application point on the outer cylindrical surface of the first inking unit cylinder, and a second inking unit cylinder, which cooperates with the first inking unit cylinder, the inking device, on at least a downstream side of the application point in an operating direction of rotation of the first inking unit cylinder, further comprising a retaining means, which is formed by a wiping means that, at least in an operating position, is in physical contact with the outer cylindrical surface of the first inking unit cylinder and configured as a doctor blade, which can be used to remove printing ink that has been applied to non-engraved regions of the outer cylindrical surface of the first inking unit cylinder, wherein two end-aligned line-like recesses on the outer cylindrical surface of the first inking unit cylinder are separated by a supporting ridge, the two end-aligned line-like recesses corresponding to a single uninterrupted line-like recess on the circumference of the forme cylinder, and wherein an upper surface of the supporting ridge lies at a level of an undisrupted region of the outer cylindrical surface of the first inking unit cylinder.

2. The gravure printing unit according to claim 1, wherein the two end-aligned line-like recesses on the outer cylindrical surface of the first inking unit cylinder that correspond to the single uninterrupted line-like recess on the circumference of the forme cylinder measure at least 500 μm in a combined length.

3. The gravure printing unit according to claim 1, wherein there are a plurality of the supporting ridges separating a plurality of pairs of the end-aligned line-like recesses on the outer cylindrical surface of the first inking unit cylinder, and the plurality of supporting ridges are arranged according to a regular structure.

4. The gravure printing unit according to claim 1, wherein there are a plurality of the supporting ridges separating a plurality of pairs of the end-aligned line-like recesses and arranged in a pattern corresponding to an open line structure comprising at least one of:

a pattern corresponding to wave structures that run in opposite directions or in a same direction, or a pattern corresponding to rectilinear and parallel lines that run rectilinearly and parallel to one another.

5. The gravure printing unit according to claim 4, wherein the plurality of supporting ridges that are arranged in the pattern corresponding to rectilinear and parallel lines are spaced apart from one another by 100 to 700 μm.

6. The gravure printing unit according to claim 4, wherein the plurality of supporting ridges that are configured in the pattern corresponding to rectilinear and parallel lines are spaced apart from one another by 200 to 600 μm.

7. The gravure printing unit according to claim 4, wherein the plurality of supporting ridges that are configured in the pattern corresponding to rectilinear and parallel lines run at an incline of 10° to 40° in relation to a line that runs parallel to the axis of rotation of the inking unit cylinder on the outer cylindrical surface.

8. The gravure printing unit according to claim 4, wherein the plurality of supporting ridges that are configured in the pattern corresponding to rectilinear and parallel lines run at an incline of 15° to 35° in relation to a line that runs parallel to the axis of rotation of the inking unit cylinder on the outer cylindrical surface.

9. The gravure printing unit according to claim 4, wherein the plurality of supporting ridges that are configured in the pattern corresponding to rectilinear and parallel lines have a ridge thickness of 10 to 50 μm at the upper surface of each supporting ridge.

10. The gravure printing unit according to claim 4, wherein the plurality of supporting ridges that are configured in the pattern corresponding to rectilinear and parallel lines have a ridge thickness of 15 to 45 μm at the upper surface of each supporting ridge.

11. The gravure printing unit according to claim 1, wherein one or more of the line-like recesses on the circumference of the forme cylinder have a width of at least 10 μm and/or no more than 1,000 μm.

12. The gravure printing unit according to claim 1, wherein the two end-aligned line-like recesses separated by the supporting ridge, and that correspond to the single uninterrupted line-like recess on the circumference of the forme cylinder, have a width that is larger by at least 40 μm and/or no more than 400 μm than a width of the corresponding single uninterrupted line-like recess on the circumference the forme cylinder.

13. The gravure printing unit according to claim 1, wherein the second inking unit cylinder includes an outer cylindrical surface having elevations that correspond to the line-like recesses on the circumference of the forme cylinder, or raised areas, which correspond to areas of the pattern of recesses.

14. The gravure printing unit according to claim 13, wherein:

the elevations match corresponding individual line-like recesses on the forme cylinder with a width that is no more than ten times greater than a width of the corresponding individual line-like recesses, and/or the elevations individually match recesses on the forme cylinder that are spaced 1000 μm or less from one another.

15. The gravure printing unit according to claim 13, wherein the elevations individually correspond to individual ones of the line-like recesses on the circumference of the forme cylinder and, in a region of a smallest width corresponding to a shortest distance between opposing edges, the elevations have a width of 1 mm or less, and/or a width that is no more than 0.8 mm greater than a width of the corresponding line-like recess on the circumference of the forme cylinder and/or which match individual recesses on the forme cylinder with a width that is no more than ten times greater and/or which individually match recesses on the forme cylinder that are spaced 1,000 μm or less from one another.

16. The gravure printing unit according to claim 1, wherein at least the retaining means, or an ink supply unit that supports the retaining means and is mounted axially movably in the inking device, can be moved axially by a drive means, in terms of an axial position relative to the first inking unit cylinder, and/or can be oscillated during operation.

17. The gravure printing unit according to claim 1, wherein a positioning drive comprising a remotely actuatable drive means is provided, by means of which the doctor blade, an ink supply unit that comprises the doctor blade, and at least an ink supply chamber, or the inking device entirely, can be set against and moved away from the outer cylindrical surface of the first inking unit cylinder and/or can be varied in terms of a force with which the doctor blade is set against the outer cylindrical surface of the first inking unit cylinder, and/or which repositions the doctor blade, the ink supply unit, or the inking device entirely when an operative end of the doctor blade becomes shortened due to wear.

18. The gravure printing unit according to claim 17, wherein the drive mean is at least one of a pressurized medium-actuated actuator or a pneumatic cylinder.

19. The gravure printing unit according to claim 1 wherein the outer cylindrical surface of the first inking unit cylinder comprises one of:

an ink transfer forme sheath that is circumferentially closed;

a ceramic outer layer; or a metallic outer layer.

20. The gravure printing unit according to claim 1, wherein the gravure printing unit is configured as an intaglio printing unit comprising the forme cylinder, which is configured as an intaglio printing cylinder, and an impression cylinder, which forms a printing nip with the forme cylinder.

21. The gravure printing unit according to claim 1, wherein:

the supporting ridge is a first supporting ridge and the two end-aligned line-like recesses comprise a first line-like recess and a second line-like recess separated by the first supporting ridge, the second line-like recess and a third line-like recess are end-aligned line-like recesses, wherein the second line-like recess and the third line-like recess are separated by a second supporting ridge having an upper surface that lies at the level of the undisrupted region of the outer cylindrical surface of the first inking unit cylinder, and the first line-like recess, the second line-like recess, and the third line-like recess together correspond to the single uninterrupted line-like recess on the circumference of the forme cylinder.

* * * * *